US005320245A

United States Patent [19]

Apps et al.

[11] Patent Number: 5,320,245

[45] Date of Patent: Jun. 14, 1994

[54] FULL-DEPTH BOTTLE CASE ASSEMBLY

[75] Inventors: William P. Apps, Anaheim; Gerald R. Koefelda, Seal Beach, both of Calif.

[73] Assignee: Rehrig-Pacific Company, Inc., Los Angeles, Calif.

[21] Appl. No.: 976,933

[22] Filed: Nov. 19, 1992

[51] Int. Cl.[5] ..... B65D 25/00

[52] U.S. Cl. ..... 220/510; 206/427

[58] Field of Search ..... 220/509, 510, 515; 206/427

[56] References Cited

U.S. PATENT DOCUMENTS

| | | | |
|---|---|---|---|
| 732,245 | 6/1903 | Weiss . | |
| 2,583,224 | 1/1952 | McDonald | 220/21 |
| 2,886,202 | 5/1959 | Waller | 40/29 |
| 3,153,294 | 10/1964 | Hay et al. | 220/21 |
| 3,240,378 | 3/1966 | Fox | 220/21 |
| 3,245,573 | 4/1966 | Bakos | 220/21 |
| 3,297,190 | 1/1967 | Cloyd | 220/21 |
| 3,327,885 | 6/1967 | Carle et al. | 220/21 |
| 3,353,704 | 11/1967 | Belcher et al. | 220/21 |
| 3,368,709 | 2/1968 | Waller | 220/510 |
| 3,568,879 | 3/1971 | Box | 220/97 |
| 3,656,650 | 4/1972 | Frater | 220/22.3 |
| 3,752,385 | 8/1973 | Woodgate | 229/15 |
| 3,773,206 | 11/1973 | Garcia | 220/510 |
| 3,998,328 | 12/1976 | Box | 206/511 |
| 4,093,101 | 6/1978 | Braun | 220/22 |
| 4,190,172 | 2/1980 | Box | 220/21 |
| 4,468,067 | 8/1984 | Jenkins | 312/140 |
| 4,538,742 | 9/1985 | Prodel | 220/21 |
| 4,846,365 | 7/1989 | Steinlein | 220/21 |
| 4,884,712 | 12/1989 | Schoeller et al. | 220/21 |
| 5,044,921 | 9/1991 | Micelli et al. | 425/451.9 |
| 5,071,026 | 12/1991 | Apps | 220/516 |
| 5,097,980 | 3/1992 | Warwick | 220/510 |

FOREIGN PATENT DOCUMENTS

| | | |
|---|---|---|
| 636543 | 12/1963 | Belgium . |
| 458070 | 7/1949 | Canada . |
| 1604094 | 12/1981 | United Kingdom . |

*Primary Examiner*—Steven M. Pollard

*Attorney, Agent, or Firm*—Banner, Birch, McKie & Beckett

[57] ABSTRACT

A full-depth bottle case assembly for different sets of bottles of different widths, such as 1.0, 1.5 and 2.0 liter PET bottles, including a full-depth bottle case and alternative first, second and third dividers. The gridwork floor construction of the bottle case includes a plurality of female locking members. Each of the dividers has a plurality of male locking members depending down therefrom. The female and male locking members are configured and positioned such that when any one of the dividers is alternatively inserted into the case the divider is removably snap secured therein. Each divider when alteratively snap secured into the case defines with the interior walls of the case a plurality of pockets, for different width bottles than the other dividers.

20 Claims, 27 Drawing Sheets

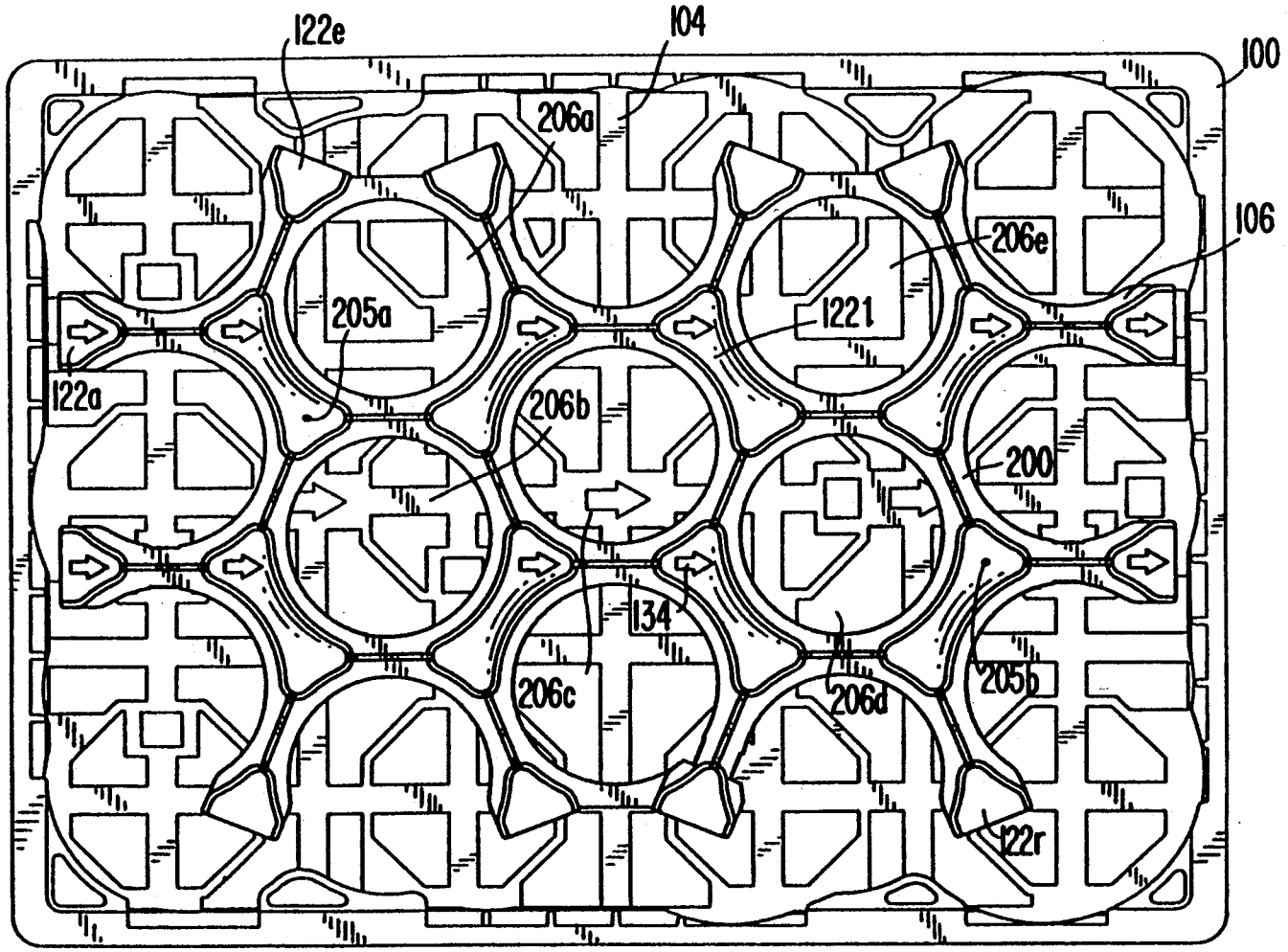
FIG. 16
FIG. 14
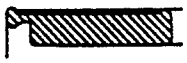
FIG. 15
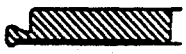

FULL-DEPTH BOTTLE CASE ASSEMBLY

BACKGROUND OF THE INVENTION

The present invention relates to full-depth cases for transporting and storing beverage bottles. It further is concerned with snap-in dividers for full-depth cases for bottles or the like.

In the past it has been the practice in the packaging industry to individually design cartons or boxes and the dividers for them for a particular use. This resulted in a variety of cartons or boxes of differing sizes and dimensions being produced. While this has the advantage of using a specific design for a particular use and thus avoids the problems of makeshift cartons or boxes, those boxes are expensive since they require separate designs for each use or container. Also, if various types and sizes of containers are to be shipped in the same storage chambers of a transportation vehicle, the cartons or boxes may not have uniform exterior dimensions, thereby wasting valuable storage space when stacked.

In particular, it is desirable to alternatively handle 1.0 liter, 1.5 liter and 2.0 liter PET bottles, depending upon the every changing market demands. In the past, as market conditions changed and different sizes of bottles needed to be handled, it was necessary to purchase a whole new "float" or supply of cases since each case was designed for only one size of bottle. These market changes can be gradual or sudden. The old cases then would have to be stored or thrown away, both being expensive alternatives. The former alternative uses valuable storage space and the latter produces unnecessary waste material.

Accordingly, a new bottle handling system is needed such that as market conditions change and a different type of material or size of bottle needs to be handled that it can be done efficiently and economically. In particular, it is desirable to have an improved system which can effectively handle, store and transport today's 1.0, 1.5 and 2.0 liter plastic returnable bottles in a commercially acceptable manner, which is compatible (that is, stackable and cross-stackable) with today's standard 309 mm by 412 mm full-depth cases, which is usable with palletizing and depalletizing machinery which hooks onto the center of the long wall of the case, which compactly cross-stacks on today's pallets without any overhang from the pallet sides, which allows chemicals and the like to be washed off the bottoms of the bottles while in the case, and whose case components cannot be easily disassembled or removed by unauthorized persons.

SUMMARY OF THE INVENTION

The present invention which is directed to achieving these objects includes a full-depth bottle case assembly for handling different sets of bottles of different sizes, using the same full-depth case for each size. All that needs to be changed to handle a different size or type of bottle is to unsnap and remove the existing bottle divider from the case and insert and snap in another differently-configured divider. To insure that each of the dividers is accurately positioned in the case a snap-in or lock mechanism is provided whereby the divider releasably snaps into the case securely and accurately in position. When snapped into place none of the dividers touches the interior surfaces of the case walls. Rather, each is spaced on all sides a distance inward from each of the walls. Although the snap-in arrangement must be releasable so that a different divider can be used when a different size bottle is to be handled, it should not be constructed such that the dividers can be freely removed by unauthorized persons for mischief or other unauthorized uses. Accordingly, the present invention provides for a secure snap-in arrangement which cannot be released simply using one's fingers but which requires the use of a special tool.

The snap-in arrangement includes rectangular female members integrally formed as part of the gridwork floor construction of the case. Each of the dividers has male locking members depending downwardly therefrom. Due to the different configurations of the dividers, the male locking members of each divider are positioned so that they will lock into different female locking members than do the other dividers. The male locking members can depend down from the web portions of the dividers which interconnect the columns of the divider, or from ribs which extend between columns across the base of interior pockets. Further, where tall bottles are to be held, the male locking members of that divider can be positioned spaced out from the walls of the divider on outwardly extending tabs so as to not interfere with the bottle pockets.

In order to maximize the number of bottles which can be handled and to accurately position the bottles, the interior wall surfaces of the case itself are utilized to form parts of the bottle pocket surfaces for the peripheral pockets. Each of the pockets must be configured to snugly hold its bottle and yet without sharp surfaces which may damage the bottle. Thus, to accommodate different sizes and numbers of bottles and to maximize the capacity of the case, each of the dividers and the interior walls of the case itself is herein carefully and uniquely configured.

The positioning and configuration of the interior wall columns also assists in the pocket formation. The case itself and at least one of the three dividers is asymmetrical about one or both of its longitudinal or lateral axes. In fact, pursuant to a preferred design all of the interior wall columns of the case are differently configured. At least one of the columns is lopsided in horizontal cross-section, having a long side and a short side. When one divider is used the long side, but the not the short side, defines part of a bottle pocket. Then when another different divider is used, the short side, but not the long side, forms a bottle pocket. Since the case and dividers are asymmetrical, the dividers can only be inserted in one orientation into the case. To minimize the amount of manipulation and frustration of determining the proper orientation of the divider with respect to the case, both are provided with arrow indicators molded thereon and indicating the proper alignment or orientation. Additionally, arrows are provided on the outside case wall to indicate the proper orientation of the case on the conveyor line.

To maximize the placement of the sets of different sizes of bottles in the case, in at least one bottle arrangement adjacent peripheral bottles are positioned so that one is closer to the center line of the case than the other. This can be accomplished by having the pocket for the closer bottle defined at least in part by an interior wall column and for the other bottle being spaced from and between the wall columns. Additionally, each of the dividers when snap locked into place is spaced from the interior surfaces of the wall. That is, none of the dividers touches the case walls when snap locked to the case floor.

Thus, pursuant to this invention and within a case having outer dimensions of only 416 mm by 312 mm; with the use of the first divider, fifteen 1.0 liter bottles can be held in the case; with the use of the second divider, twelve 1.5 liter bottles can be held; and with the use of the third divider, nine 2.0 liter bottles can be held, thereby maximizing the storage space available for those case dimensions and for these three bottle sizes. This case advantageously can be column stacked and cross-stacked with the standard 309 mm by 412 mm cases, and can be stacked on pallets with today's dimensions, such as 1250 mm by 1050 mm, without any overhang.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 14 is an enlarged cross-sectional view taken on line 14—14 of FIG. 1.

FIG. 15 is an enlarged cross-sectional view taken on line 15—15 of FIG. 1.

FIG. 16 is a top plan view of the case of FIG. 1 with a first divider of the present invention snap secured therein.

DETAILED DESCRIPTION OF PREFERRED EMBODIMENTS OF THE INVENTION

Figure 13:
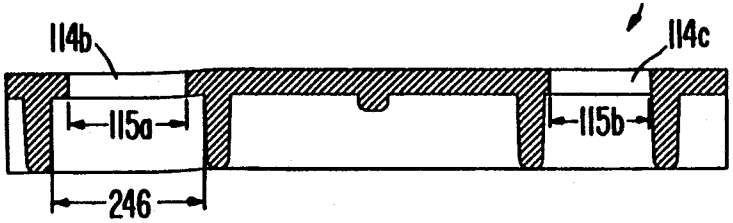
FIG. 13 is an enlarged cross-sectional view taken on line 13—13 of FIG. 6.

Referring to the drawings, preferred embodiments of the present full-depth bottle case assembly invention are illustrated. This assembly includes a full-depth bottle case 100 shown in FIGS. 1-6, for example, formed of high density polyethylene or similar material in an injection molding process, and including a wall structure shown generally at 102 and a floor construction shown generally at 104. Alternative first, second, and third dividers of this assembly invention are shown generally by reference numerals 106, 108 and 110, respectively, in isolation and in top plan views in FIGS. 18, 27 and 37, respectively. The floor construction 104, as shown in FIG. 16, is of a gridwork design having a pattern of ribs and openings, whose layout is described later, to reduce the amount of plastic used and thereby the weight and cost of the case 100 and also to provide for drainage of wash water, rain water, product spillage and the like out the bottom of the case. Integrally formed as part of the floor construction 104 are a plurality of rectangular open ribbed members 114 (particularly, 114*a–j*) defining the female portions of a divider snap securing system of the invention. Referring to FIG. 13, it is seen that the female locking member 114 has a typical length 115*a* of 14.00 mm and a typical width 115*b* of 12.00 mm.

Figure 17:
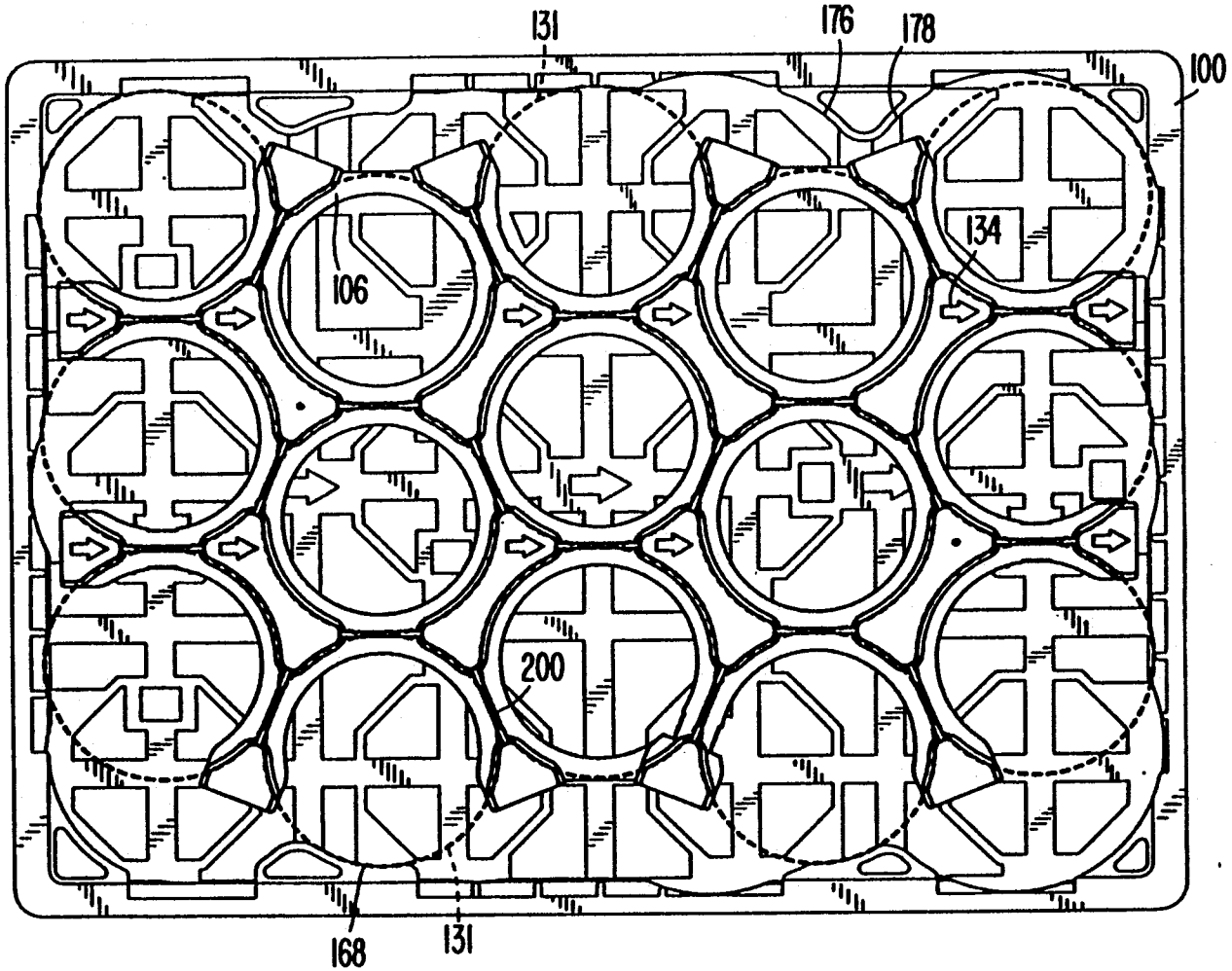
FIG. 17 is a view similar to FIG. 16 showing with dotted circles the (1.0 liter) bottles positioned in the case.
Figure 26:
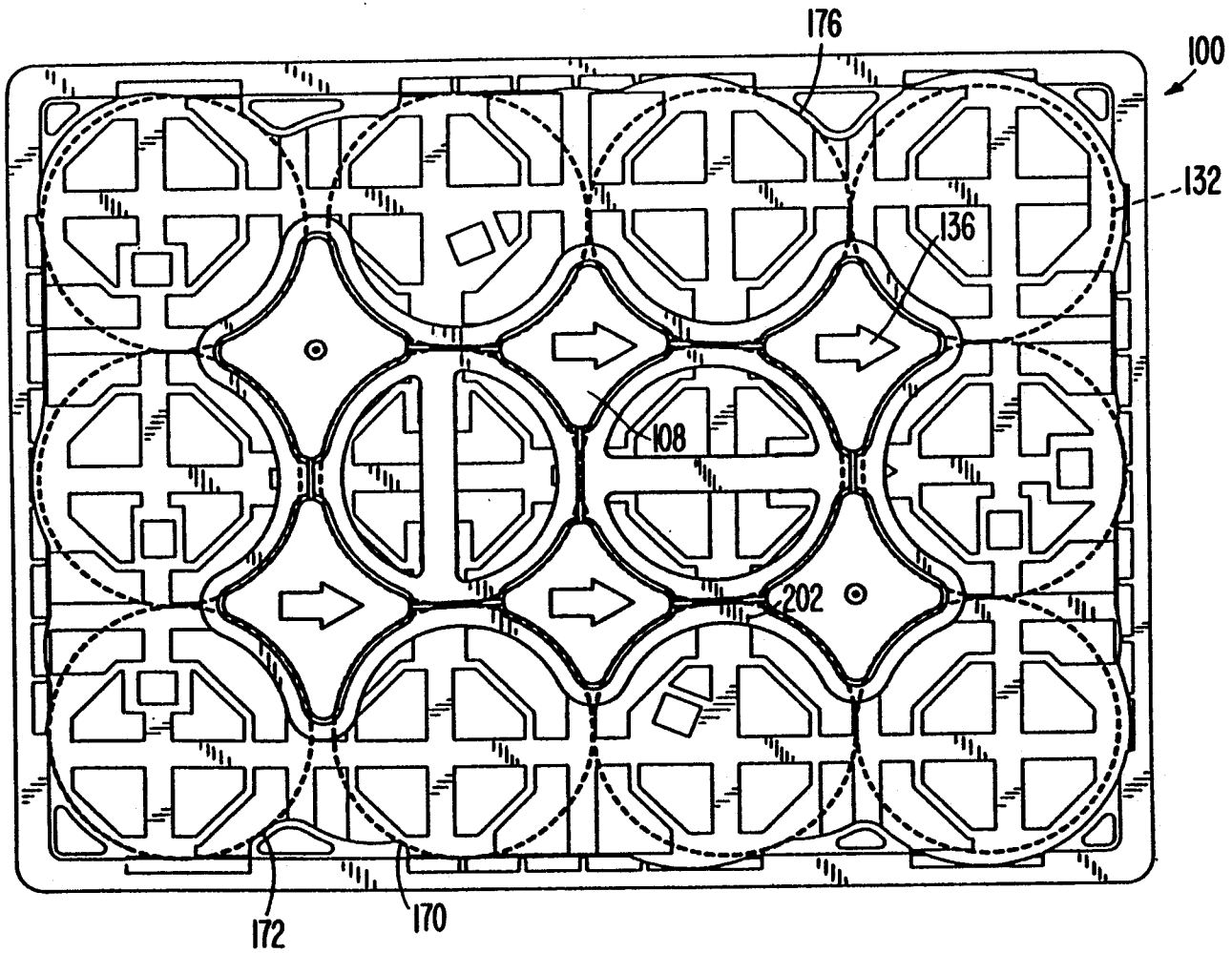
FIG. 26 is a view similar to FIG. 25 showing with dotted circles the (1.5 liter) bottles positioned in the case.
Figure 36:
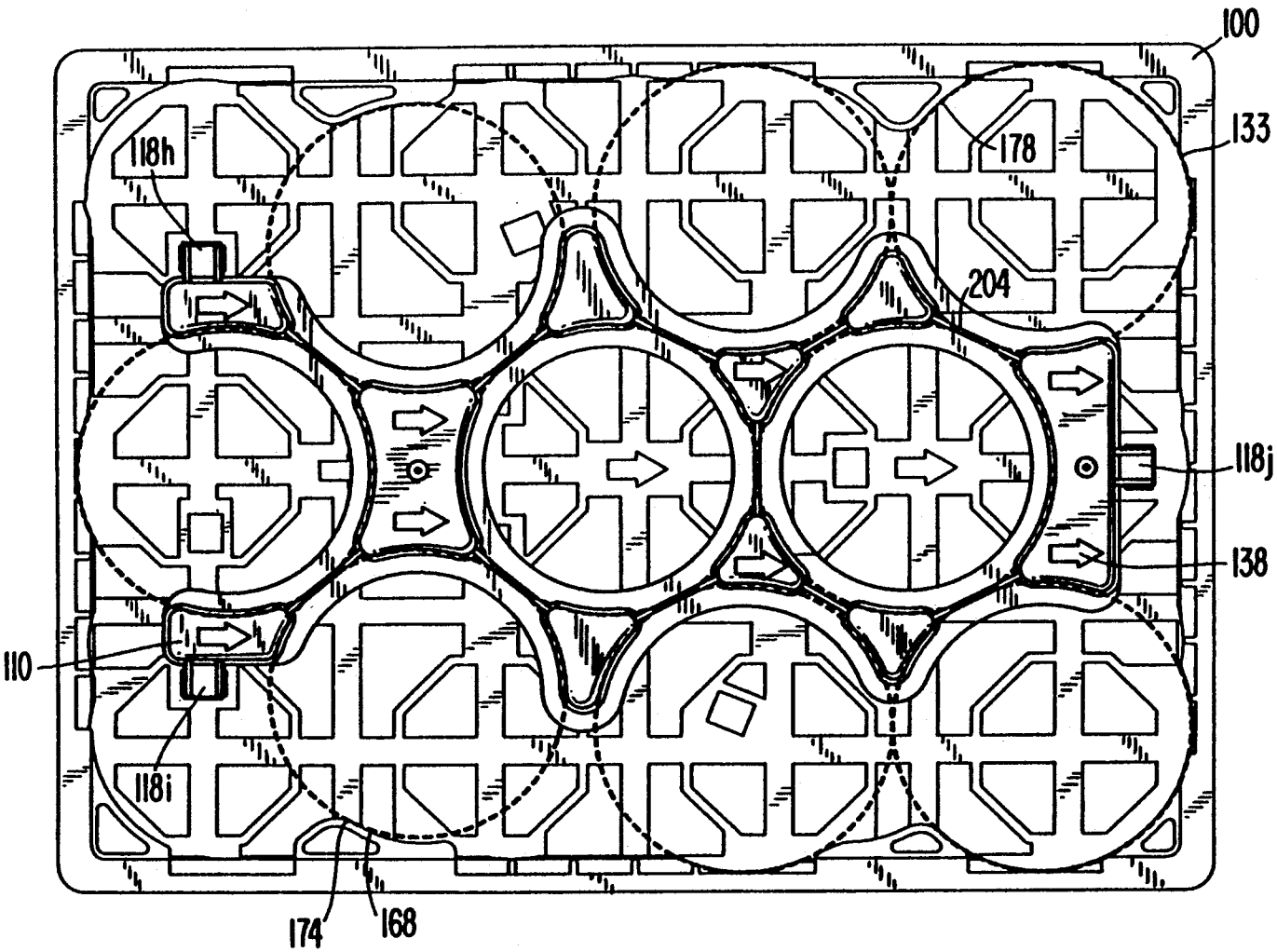
FIG. 36 is a view similar to FIG. 35 showing with dotted circles the (2.0 liter) bottles positioned in the case.

Depending down from and integrally formed with each of the dividers 106, 108, 110 are male locking members 118 (particularly, 118*a, b, c* and *d* for divider 106; 118*e, f* and *g* for divider 108; and 118*h, i* and *j* for divider 110), to be described in detail later, which when the divider is inserted in the proper orientation down in through the open top of the case 100, snap secure down into the corresponding female locking members 114 in the floor construction 104. When each of the dividers 106, 108 and 110 is alternatively snap fit into the case 100, that divider, the floor construction 104 and the wall structure 102 together define holding pockets for retaining in a snug upright manner beverage bottles B1, B2, B3 or the like. They provide for positive bottle location in the case 100, so that the automatic bottle de-nester machine can consistently and accurately remove the bottles B1, B2, B3 from the full-depth bottle case assembly. Referring to FIG. 17, it is seen that when the first divider 106 is fit into the case 100 fifteen pockets, each for a 1.0 liter bottle B1, are formed. Referring to FIG. 26, when the second divider 108 is snap fit into the case 100 twelve pockets, each for a 1.5 liter bottle B2, are defined. FIG. 36 shows that with the third divider 110 in place nine pockets, each for a 2.0 liter bottle B3, are defined. The 1.0, 1.5 and 2.0 liter bottles each have maximum diameters of 83.8, 96.0 and 108.0 millimeters, respectively, which are the dimensions after molding plus any expansion due to carbonation or heat.

Figure 42:
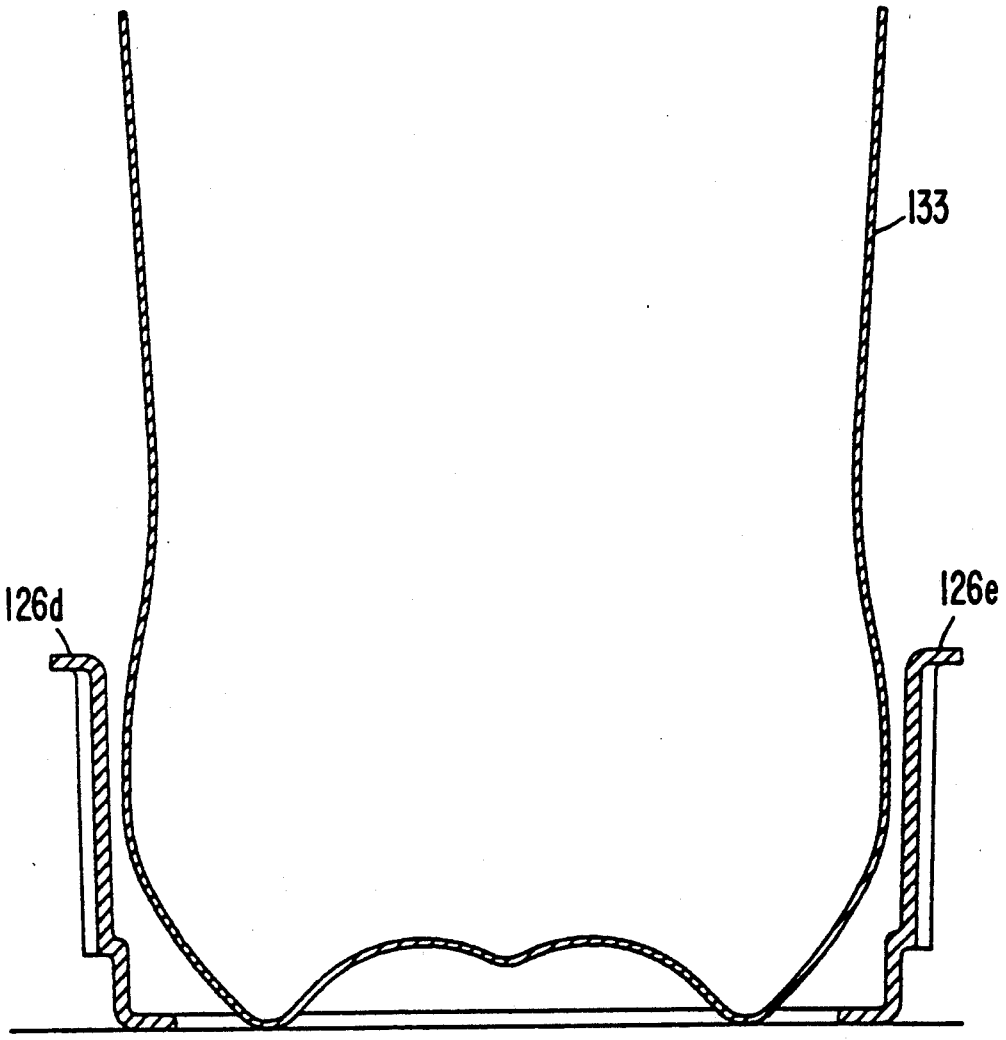
FIG. 42 is a view similar to FIG. 41 illustrating a bottle held therein, similar to the corresponding (2.0 liter) bottle of FIG. 36.

As will be appreciated, each of these pockets is configured to allow the appropriate bottles B1, B2 or B3 to be easily inserted therein but retained upright in a commercially satisfactory manner by providing support along a number of sides thereof. The pockets closely hug their bottles B1, B2, B3 providing only a couple of millimeters of play, at most, for the bottle held therein. The columns 122*a–t* of divider 106, 124*a–f* of divider 108, and 126*a–j* of divider 110 are tapered, so that at the bottom of the columns the (pocket) space is actually narrower than the maximum diameter of the bottle B1, B2 or B3 as can be seen in the cross-sectional view of FIG. 42. Since the bottles themselves are tapered and the bottoms thereof are rounded, there is sufficient clearance to insert a bottle into and to remove it from the pocket. The interior wall surfaces of the wall structure 102 of the case 100 and the various surfaces of the dividers 106, 108, 110 are uniquely configured to form these pockets as is discussed below.

Figure 18:
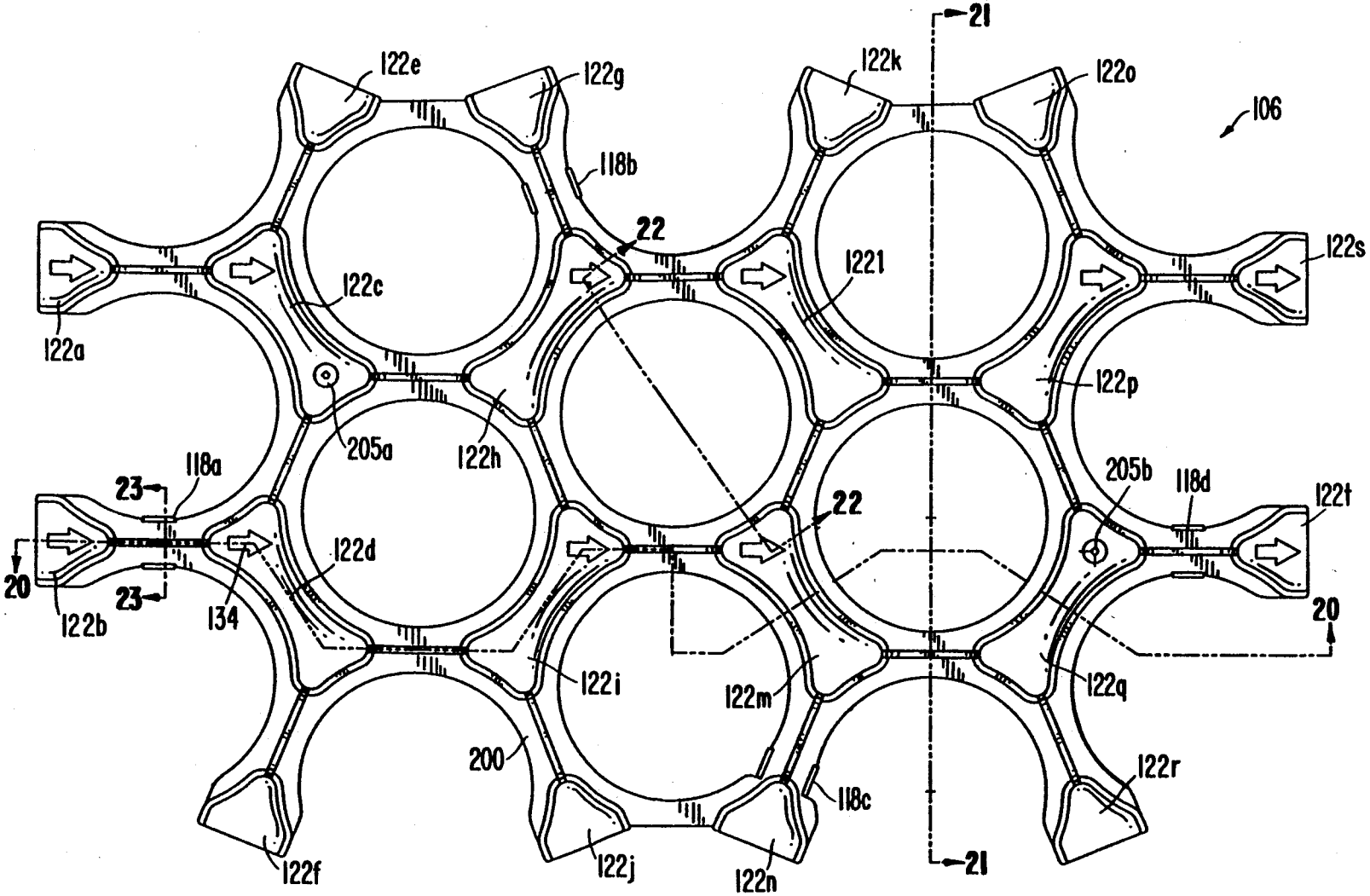
FIG. 18 is an enlarged top plan view of the divider of FIG. 16, illustrated in isolation.
Figure 19:
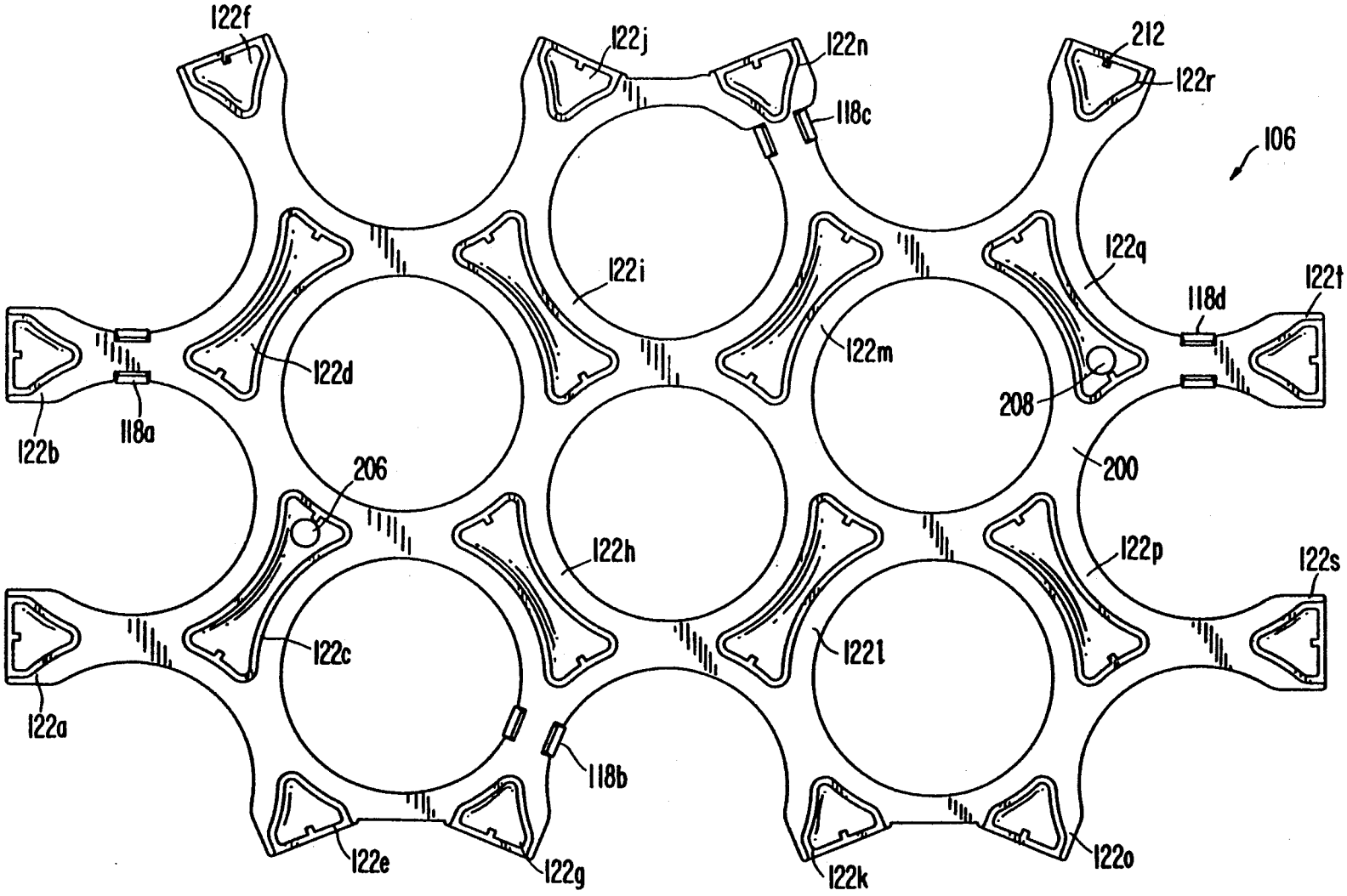
FIG. 19 is a bottom plan view of the divider of FIG. 18.
Figure 25:
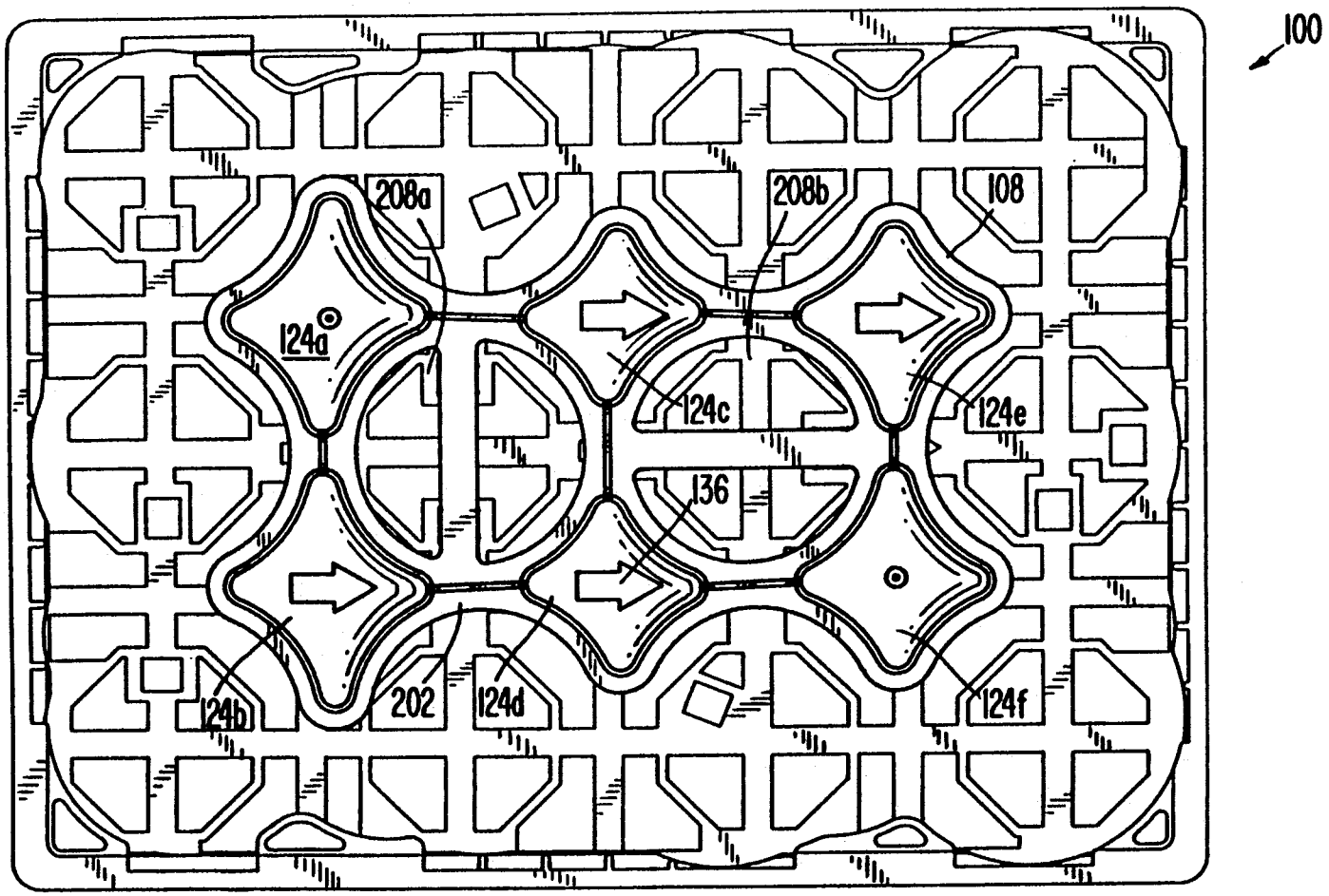
FIG. 25 is a top plan view of the case of FIG. 1 with a second divider of the present invention snap secured therein.
Figure 27:
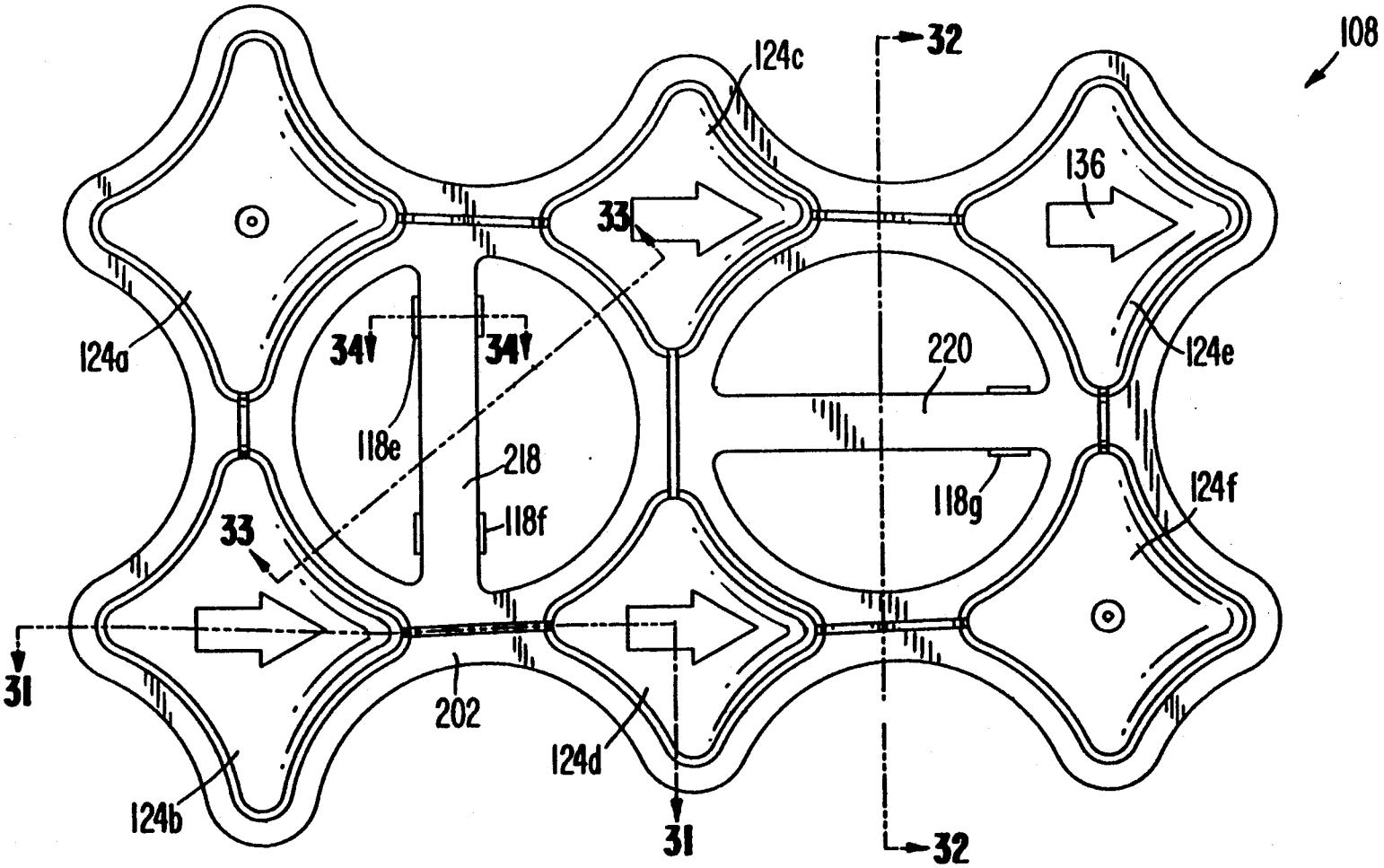
FIG. 27 is a top plan view of the divider of FIG. 25, illustrated in isolation.
Figure 28:
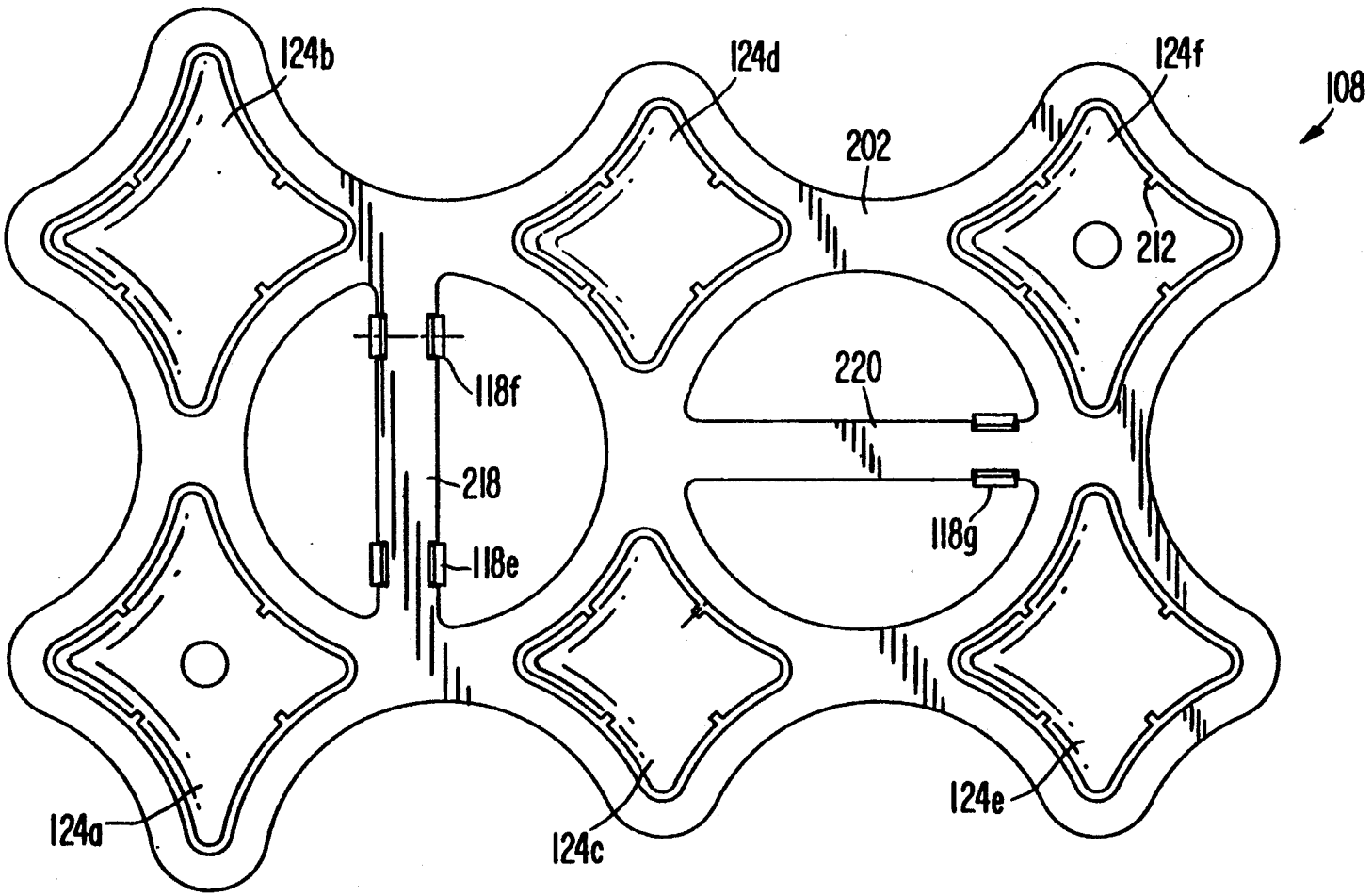
FIG. 28 is a bottom plan view of the divider of FIG. 27.
Figure 35:
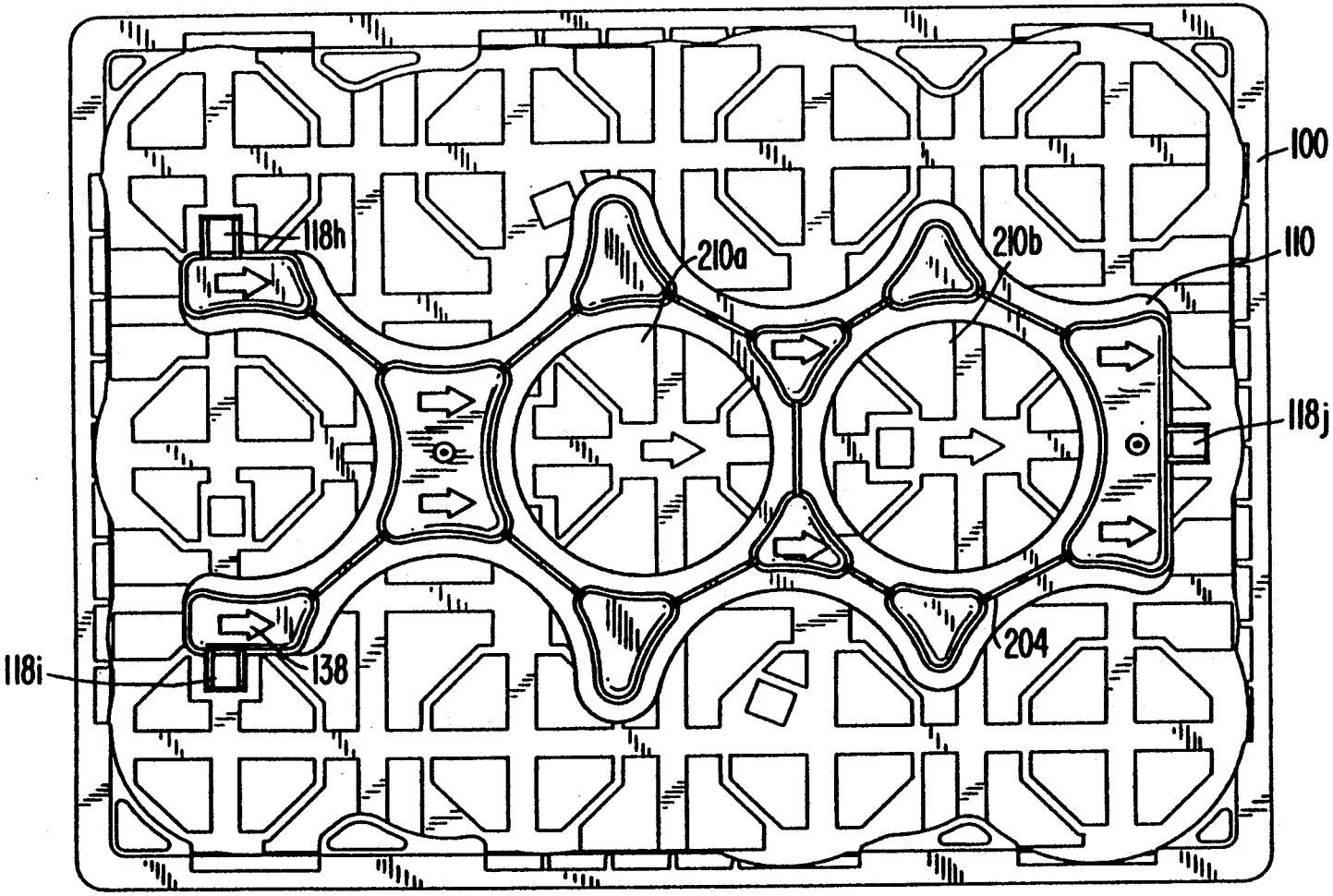
FIG. 35 is a top plane view of the case of FIG. 1 with a third divider of the present invention shown snap secured therein.
Figure 37:
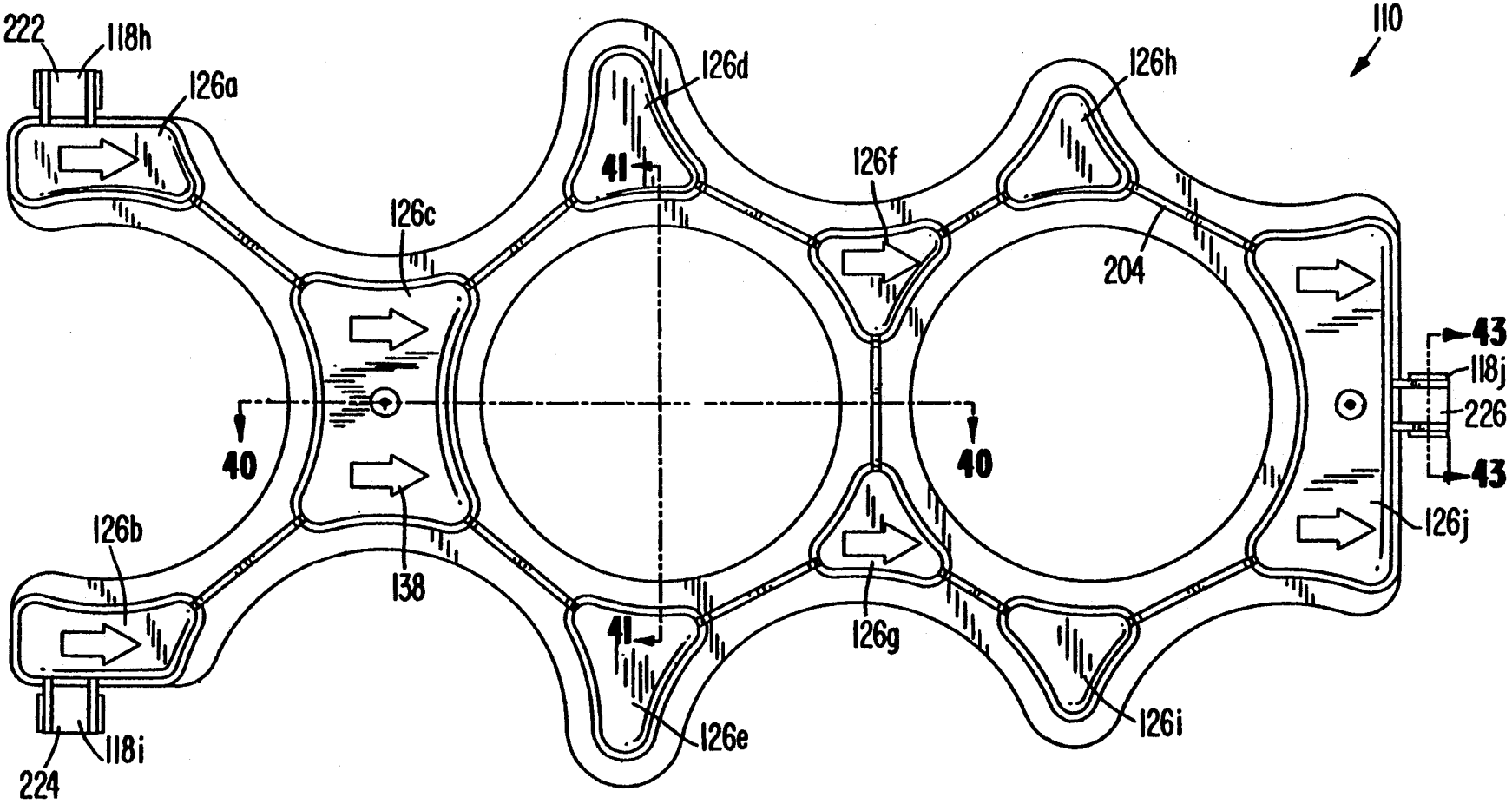
FIG. 37 is an enlarged top plan view of the divider of FIG. 35, illustrated in isolation.
Figure 38:
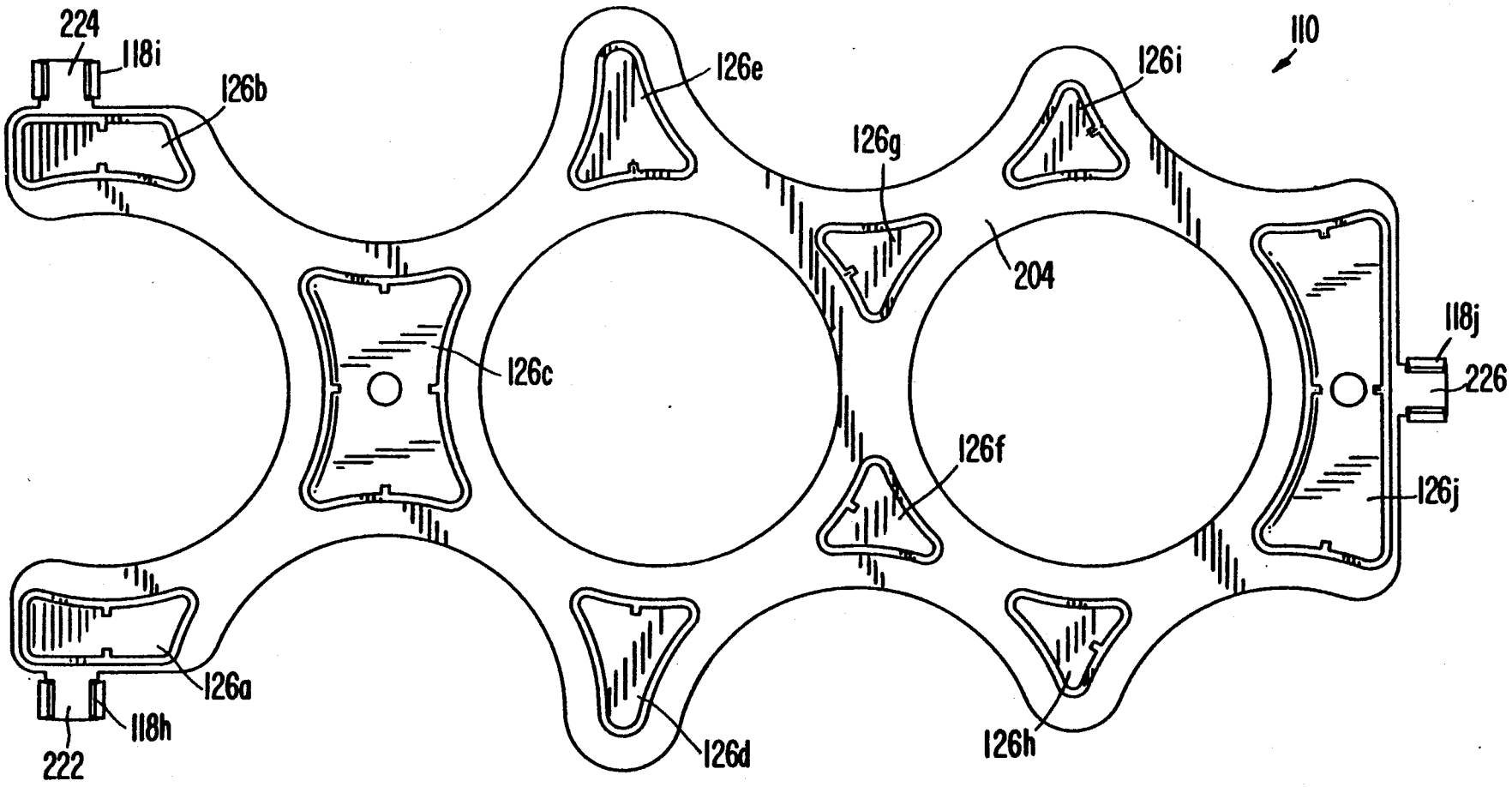
FIG. 38 is a bottom plan view of the divider of FIG. 37.

To maximize the bottle holding capability for these three different bottle sizes and within the dimension strictures of the outer boundaries of the case 100 and to provide an effective snap securing means interlock, the case 100 itself, and the first, second and third dividers 106, 108, 110 are each asymmetrical about their lateral and longitudinal axes. Thus, for each divider 106, 108, 110 there is only one orientation relative to the case 100 in which it can be inserted and locked into place in the corresponding female locking members 114 of the floor construction 104. To assist the user in quickly selecting this orientation without unnecessary trial and error, indicators are provided on both the case 100 and on each of the dividers 106, 108 and 110. These indicators preferably take the form of arrows 128, 130, 132 integrally molded with the case of the dividers and pointing in the alignment direction. On the case 100, the arrows 128, 130, 132 are molded at upper portions of a long wall (FIG. 3) and a short wall (FIG. 4) and on top of the floor construction 104 (FIG. 1), respectively. Arrows 128, 130 are used to correctly orient the asymmetrical case 100 on the material handling equipment, such as the conveyors. The arrows 134, 136, 138, in turn, are molded on top of the columns 122, 124, 126 of the dividers 106, 108, 110, as shown in FIGS. 18, 27 and 37. Thus, with the arrows 132 of the case 100 pointing in one direction relative to the user, such as to his right as shown in the FIG. 1, the desired divider 106, 108 or 110 is oriented so that its arrows 134, 136 or 138 also point to the right and that divider is then inserted into the case and snap fit into place in the respective female locking members 114 of the floor construction 104. This orientation of the arrows 134, 136 or 138 of the divider 106, 108 or 110 with those arrows 132 of the case 100 can be understood from FIGS. 16, 25 and 35. The arrows 134, 136, 138 on the dividers 106, 108, 110 are not, for production reasons, located directly on the "gates."

Both of the two long walls 142, 144 of the case 110 have a pair of inwardly disposed central columns 146, 148, 150, 152, spaced from each other and from the corner columns 154, 156, 158, 160 of the case at the intersection with the case short walls 162, 163. Each of the central and corner columns extends between the top and bottom bands or portions 164, 165 of the wall structure 102. The very top of the top portion 164 are undercut as shown in FIGS. 10, 14 and 15. While FIGS. 14 and 15 illustrate cross-sections through top wall ribs, the cross-section of FIG. 10 is taken between ribs. Each of the central and corner columns provides structural strength to the case 100, and each has a hollow core to reduce the weight thereof. Each also is uniquely configured with curving surfaces, as seen in the top view of FIG. 1 and the sectional view of FIG. 9, to assist in forming the bottle holding pockets.

Figure 1:
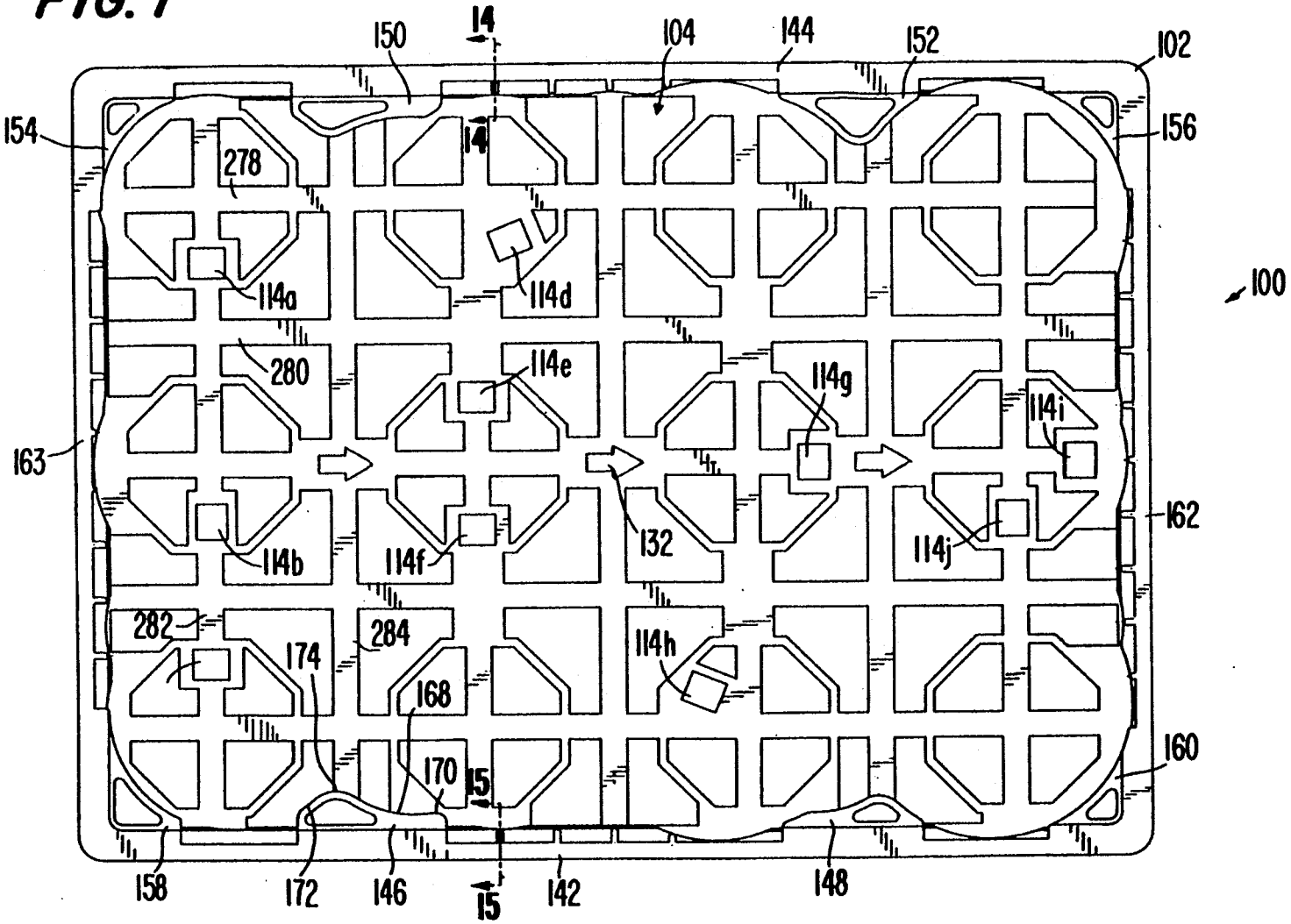
FIG. 1 is a top plan view of a full-depth bottle case of the present invention.
Figure 2:
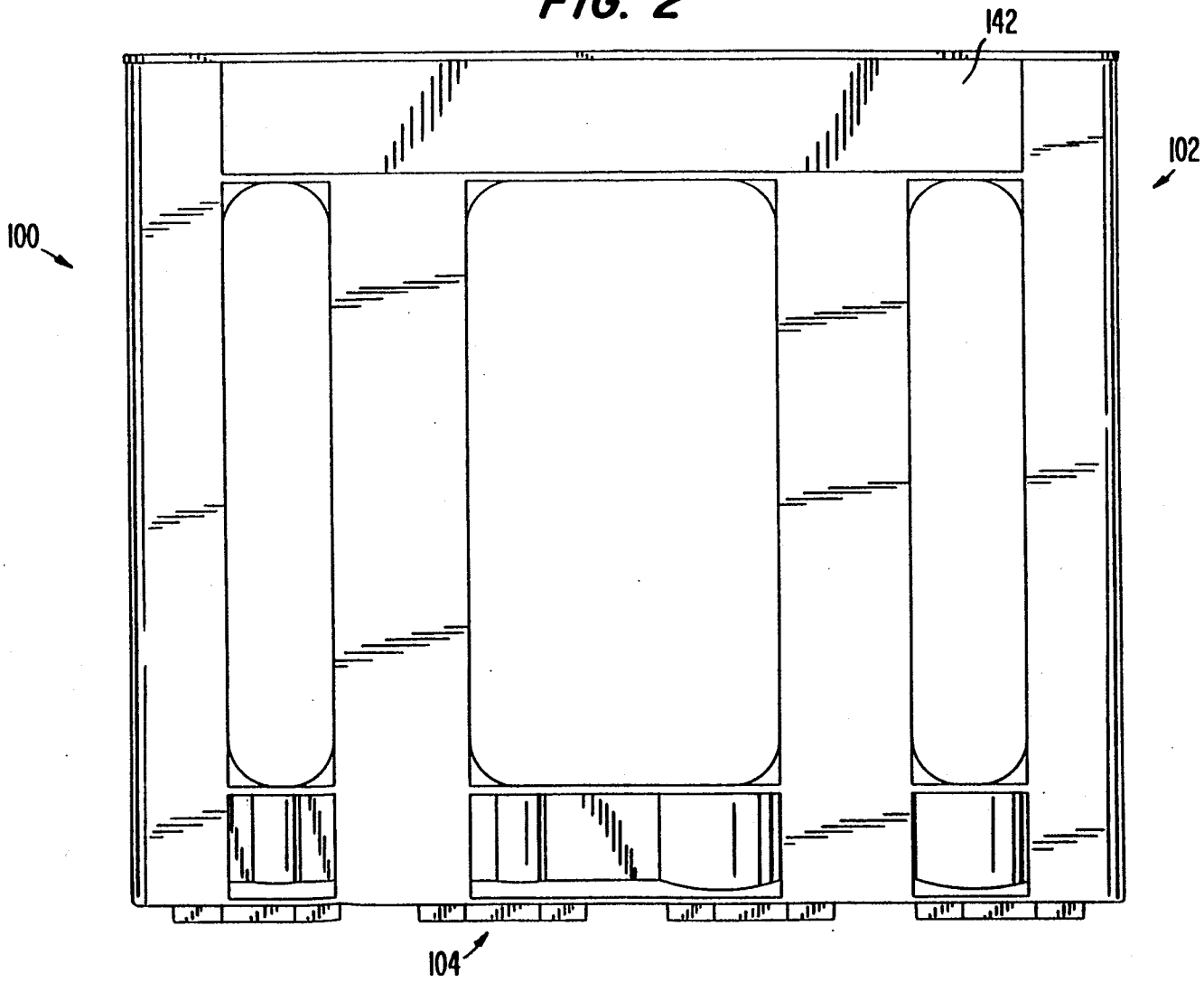
FIG. 2 is a front elevational view of the case of FIG. 1.
Figure 3:
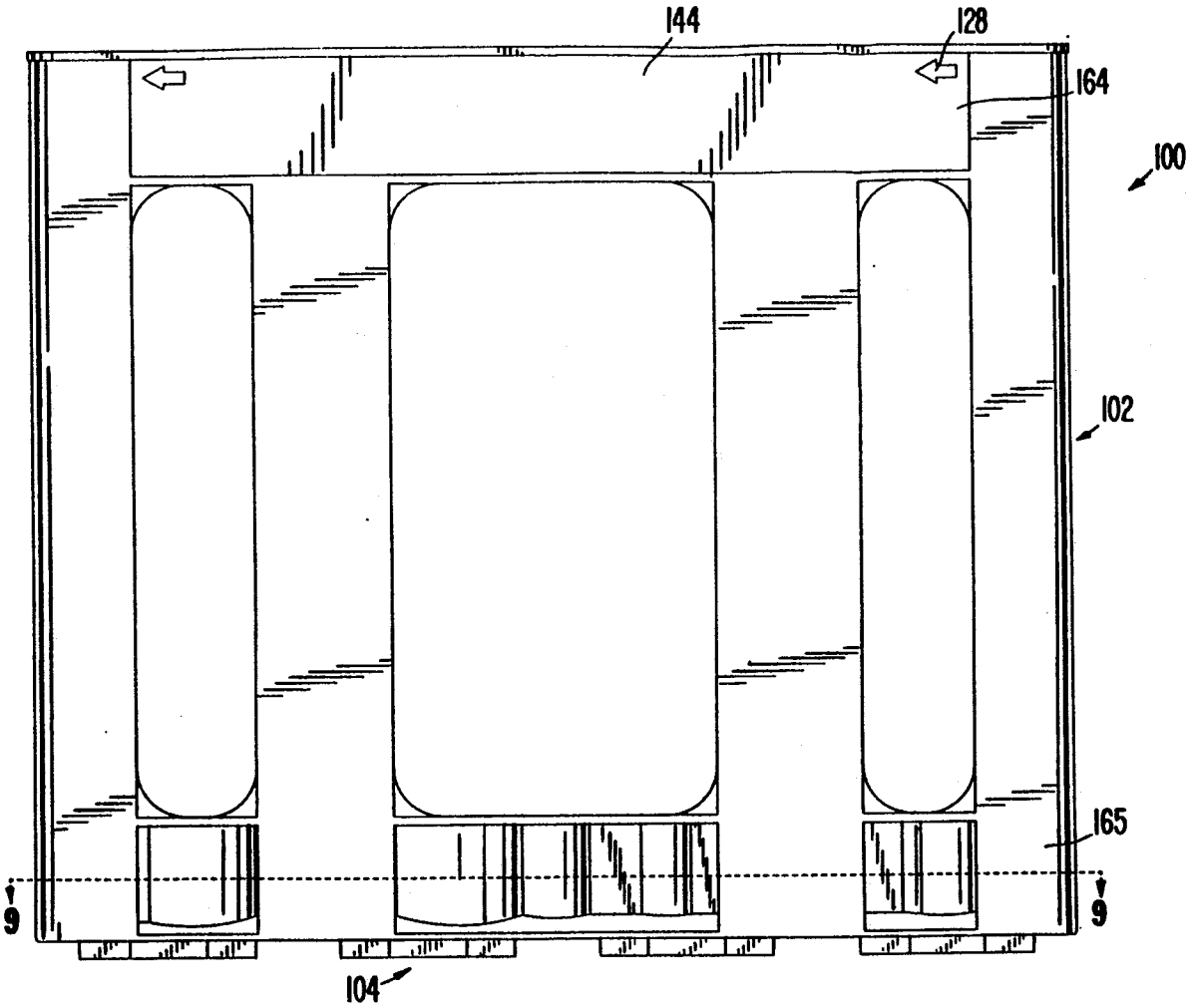
FIG. 3 is a rear elevational view thereof.
Figure 4:
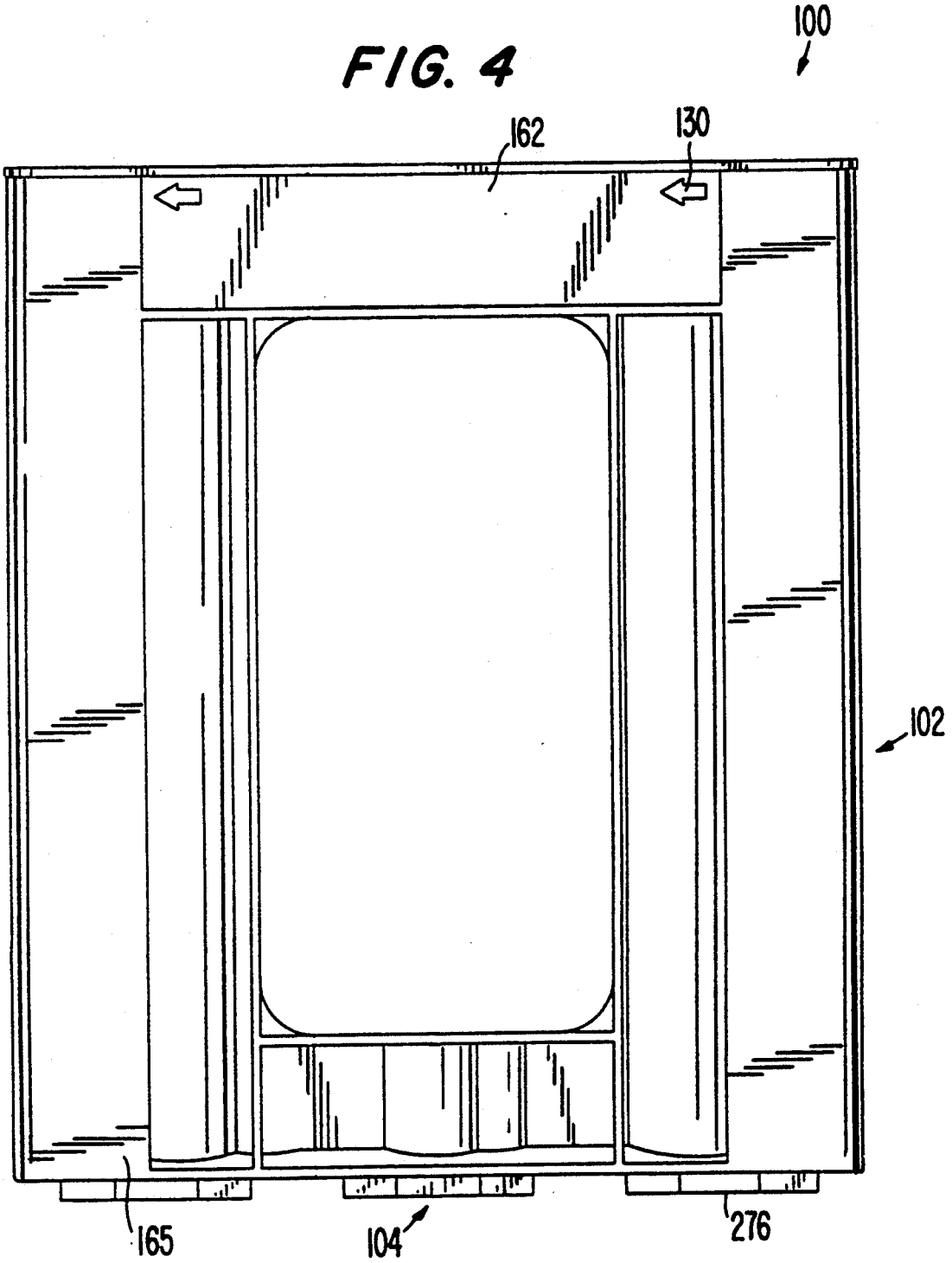
FIG. 4 is a right end elevational view thereof.
Figure 5:
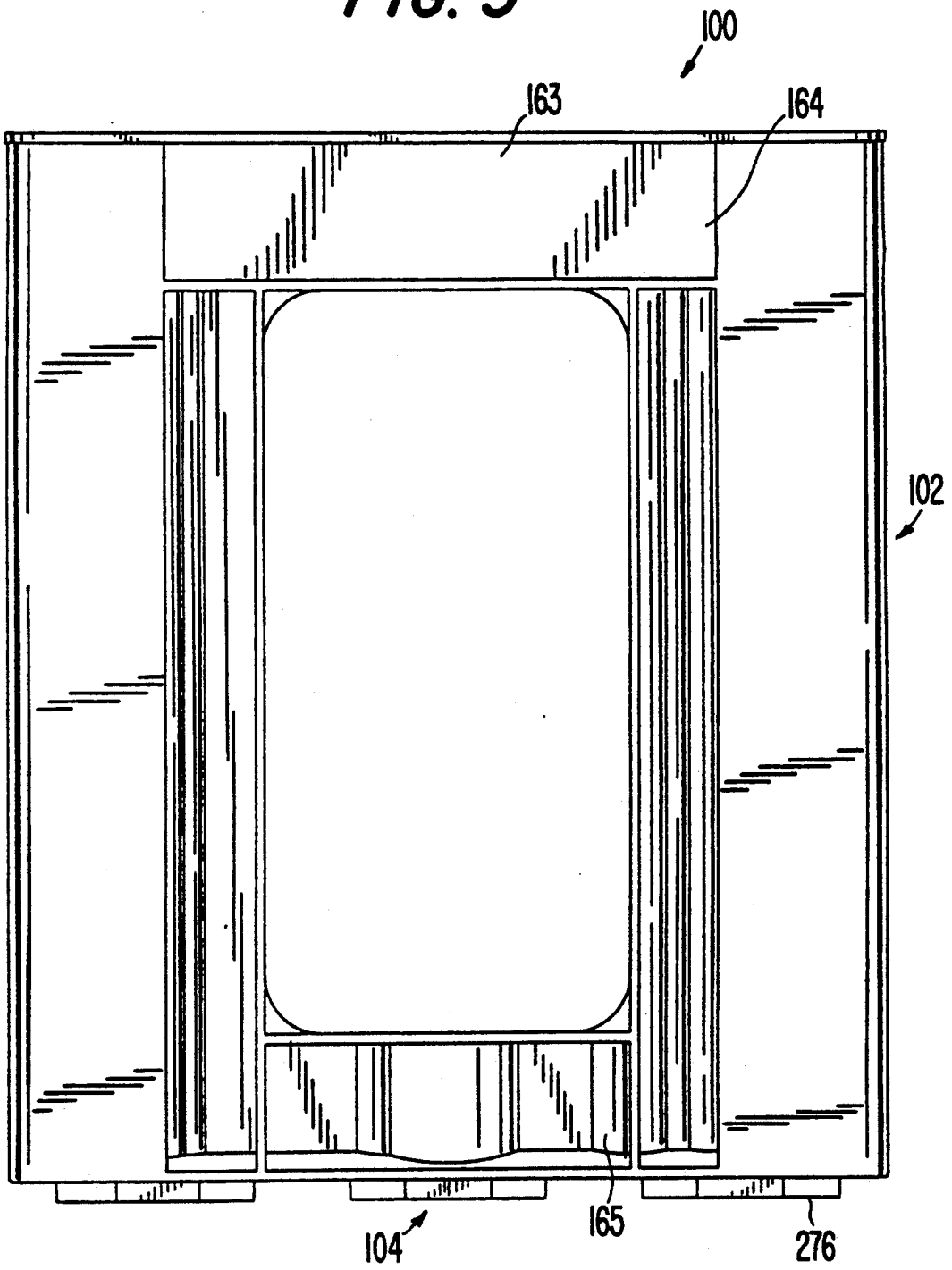
FIG. 5 is a left end elevational view thereof.
Figure 9:
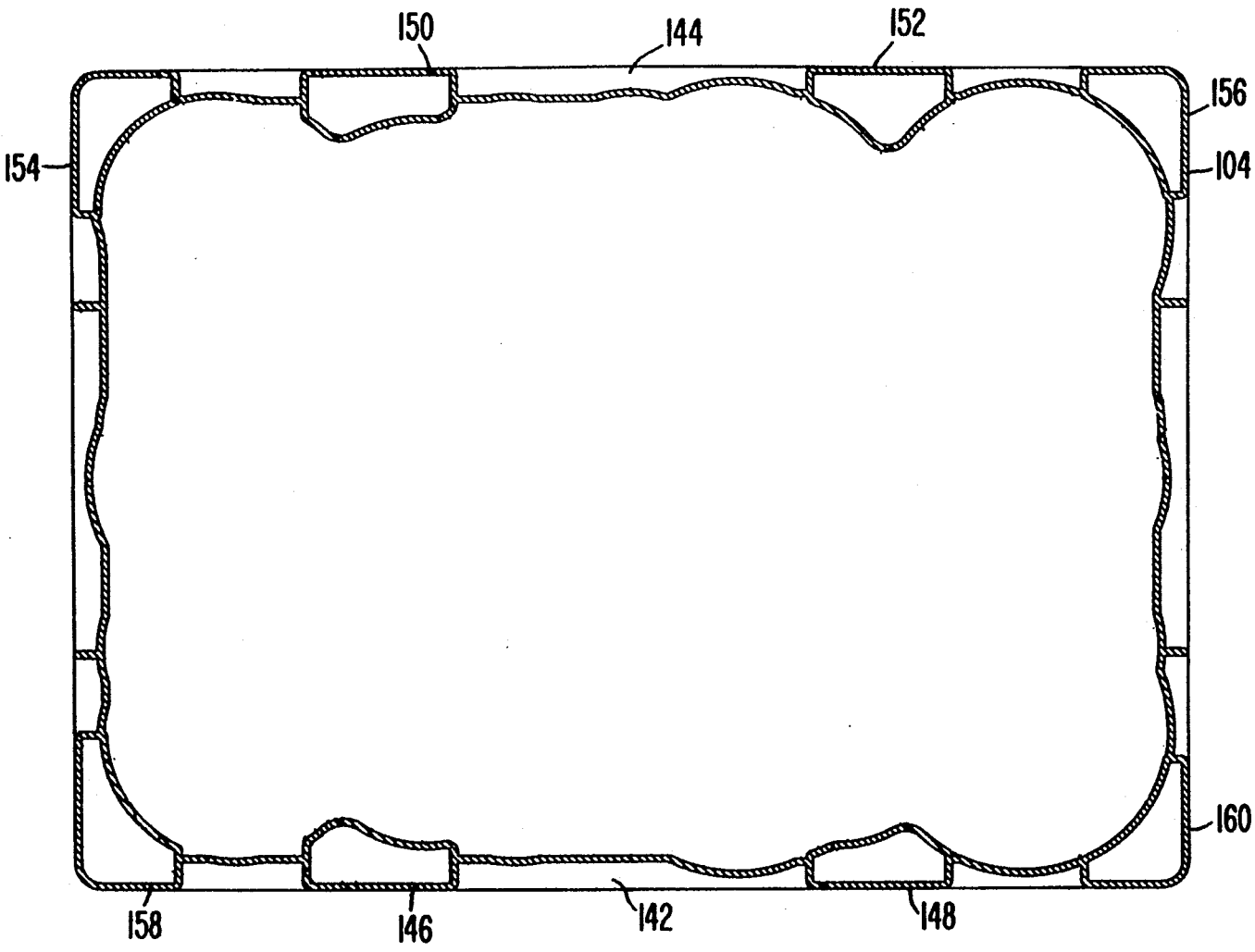
FIG. 9 is a cross-sectional view taken on line 9—9 of FIG. 3.
Figure 12:
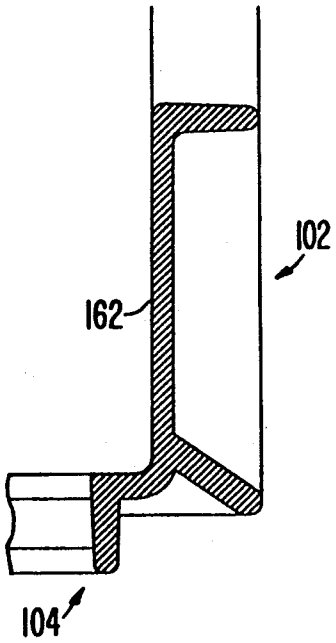
FIG. 12 is an enlarged cross-sectional view taken on line 12—12 of FIG. 6.
Figure 11:
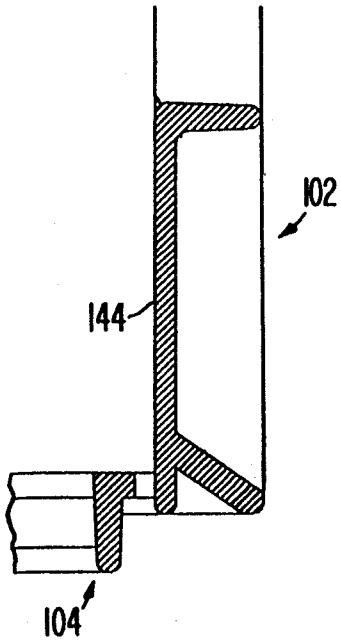
FIG. 11 is an enlarged view taken on circle 11 of FIG. 7.
Figure 10:
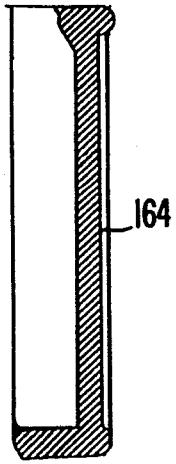
FIG. 10 is an enlarged view taken on circle 10 of FIG. 7.

As seen in FIGS. 1 and 9, each of the four central columns 146, 148, 150, 152 in a top view or a horizontal cross section through them has a different configuration. No two are the same, and in fact none is even symmetrical about its lateral axis. It is shown in FIGS. 17, 26 and 36 how the interior surfaces of the wall structure 102 form different portions of the pockets for each of the dividers 106, 108, 110. This includes not only the surfaces of each of the central columns 146, 148, 150, 152 but also the surfaces of the wall structure 102 between the central columns and also the corner columns 154, 156, 158, 160. For example, the lower left corner column 158 forms part of a bottle pocket in the FIG. 26 embodiment, the upper left and right corner columns 154, 156 form parts of the pockets in the FIG. 17 embodiment and the top and bottom right corner columns 156, 160 form parts of the pockets in the FIG. 36 embodiment.

As a specific example of how the different configurations of the central columns 146, 148, 150, 152 can be uniquely employed according to this invention to maximize the carrying capability of 1.0, 1.5 and 2.0 liter bottles in the case 100, reference is made to the lower left column 146. This column 146 has a long side 168 curving inboardly with a short outboardly curving end 170, a short inboardly curving side 172 and an outboardly curving connection portion 174. In the FIG. 17 arrangement only the long curving side 160 forms a bottle receiving pocket. For the FIG. 26 embodiment the short curving side 172 forms a portion of one bottle receiving pocket and the distal end 170 forms a very small portion of an adjacent pocket. While for the FIG. 36 embodiment, only a portion of the long curving side 168 and the connection portion 174 form part of a bottle receiving pocket.

Referring to the upper right central column 152, which is more symmetrical than central column 146, but still not perfectly symmetrical, the left side thereof 176 forms a portion of a bottle receiving pocket in the FIG. 26 embodiment. No surface of this column is utilized to retain bottles in FIG. 17, however, and in FIG. 36 the majority of the right side 178 of the column is used for one bottle pocket and the corner of the left side 176 is used for an adjacent bottle pocket.

When a portion of one of the columns is used to form part of the bottle holding pocket especially a portion closer to the central (most inboard) area of the column such as connection portion 174, the pocket is spaced a distance further inward from the walls 142 (or 144) than would be the peripheral bottle receiving compartment between the columns 146, 148 (or 150, 152). This is understood with reference to FIG. 36.

Figure 6:
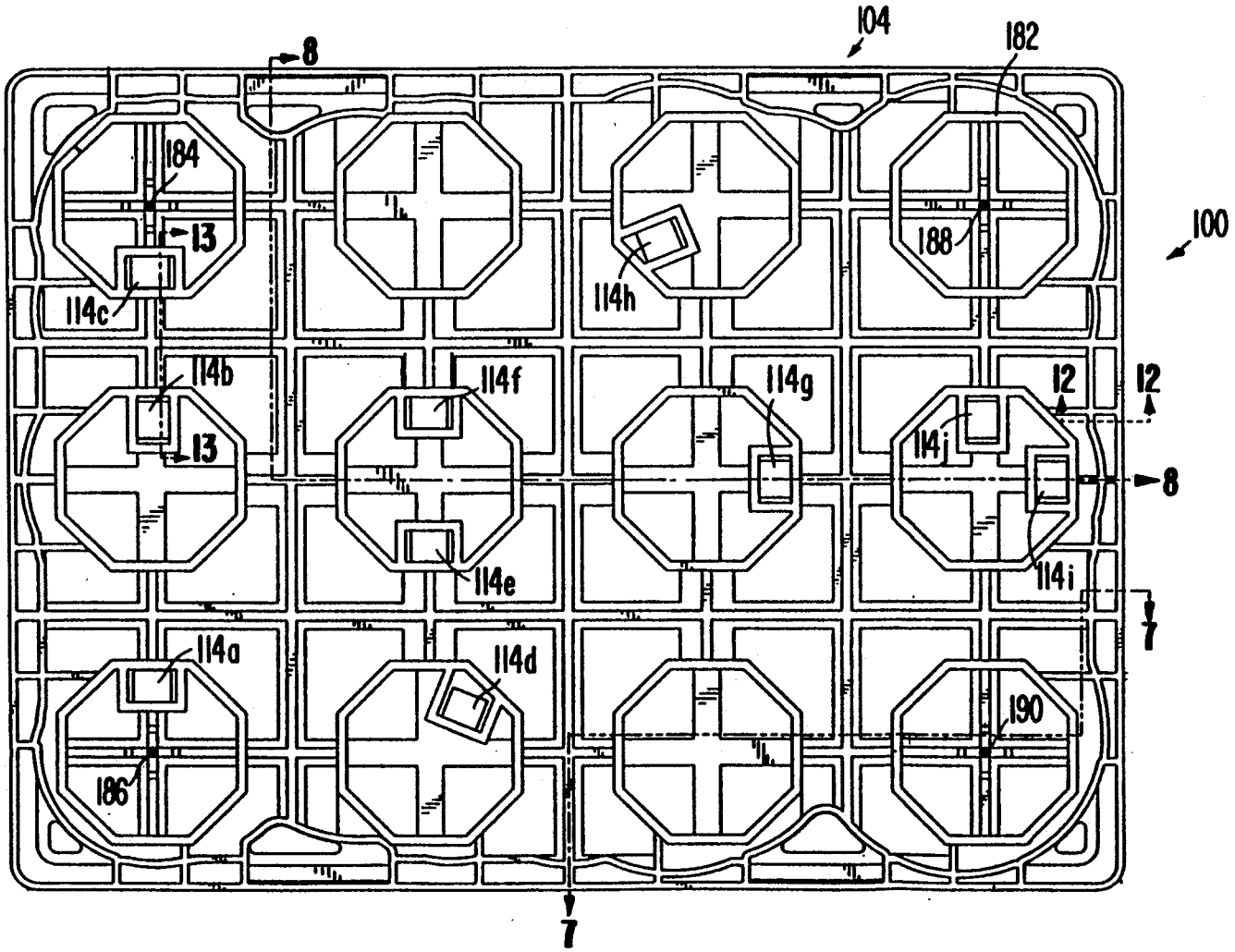
FIG. 6 is a bottom plan view thereof.
Figure 8:
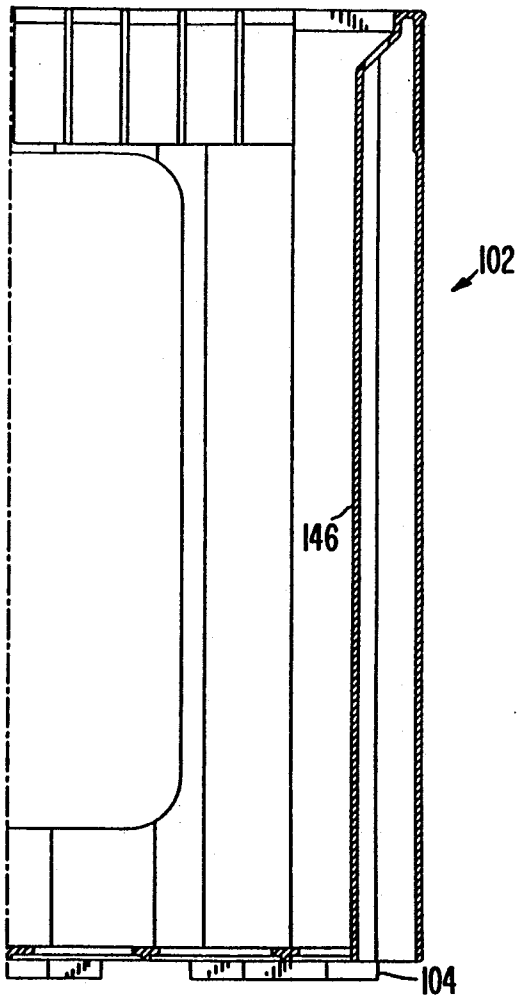
FIG. 8 is a cross-sectional view taken on line 8—8 of FIG. 6.
Figure 7:
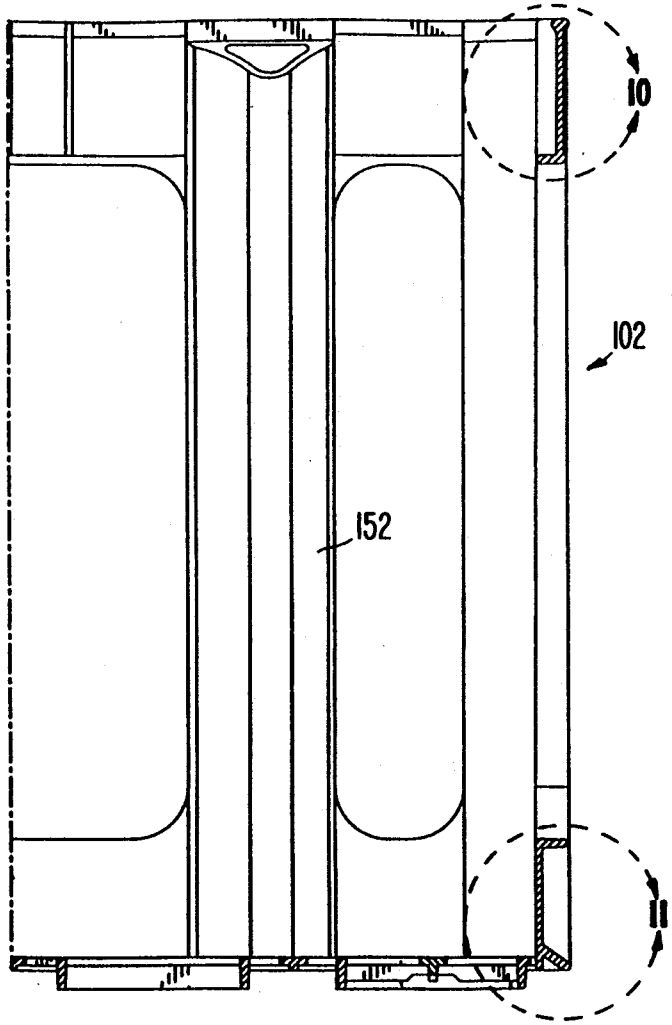
FIG. 7 is a cross-sectional view taken on line 7—7 of FIG. 6.

Referring to FIG. 6 for example, in the molding process very small ridges 182 are added to each of the full depth ribs to form friction surfaces to the bottom of the case 100. This is because wear and tear, its bottom surface is very slippery. Thus, when a few cases are stacked on a pallet (not shown) and the pallet is moved quickly the cases can slide off of it. The ridges 182 thus provide a friction surface between the bottom of the plastic case 100 and the top of the wooden pallet. The four gates where the plastic is injected to mold the case 100 are shown in FIG. 6 at 184, 186, 188, 190 in the centers of the corner octagons with ribs in the shape of a cross provided to assist the plastic flow.

Figure 24:
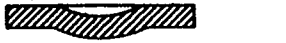
FIG. 24 is an enlarged cross-sectional view taken through one of the gates of the divider of FIG. 18.

The dividers 106, 108, 110 themselves are also injection molded of high-density polyethylene and are formed by the columns 122, 124, 126 interconnected by upright webs 200, 202, 204. For the first divider 106 two injection points or gates 205*a*, 205*b* are used. These gates (205*a*) are shown in cross-sectional detail in FIG. 24. The gates for the second and third dividers 108, 110 are similarly configured. The first divider 106 has twenty columns 122, the second divider 108 has six columns 124, and the third divider 110 ten columns, as shown in the drawings. The columns 122, 124, 126 are each either three or four sided, with rounded corners and inwardly curving sides typically. The columns 122, 124, 126 and webs 200, 202, 204 are curved to form at least portions of the sides 126 of the pockets, as can be understood from FIGS. 16, 25 and 35. For the first divider 106 the columns 122 and the webs 200 define, by completely encircling, five interior pockets 206*a–e*. Similarly, the second and third dividers each define only two interior pockets, 208*a*, 208*b*, and 210*a*, 210*b*, respectively.

Figure 20:
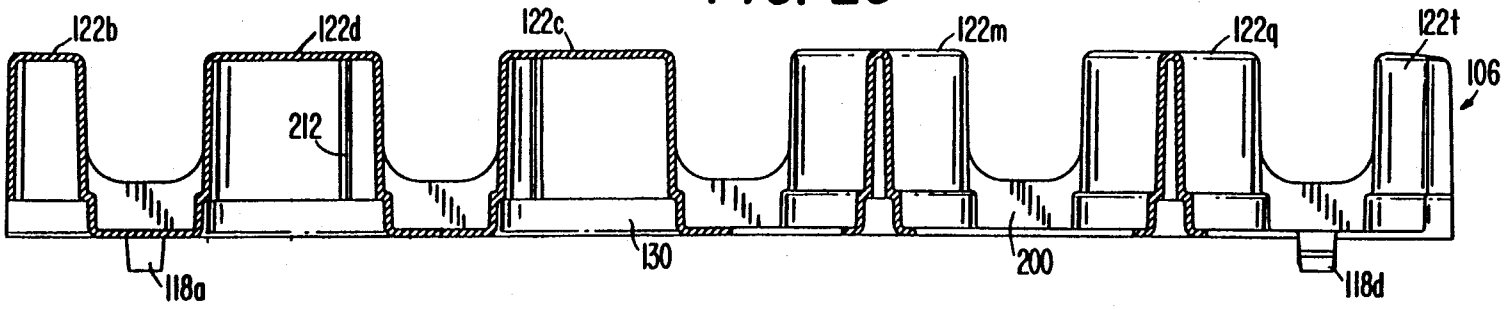
FIG. 20 is a cross-sectional view taken on line 20—20 of FIG. 18.
Figure 22:
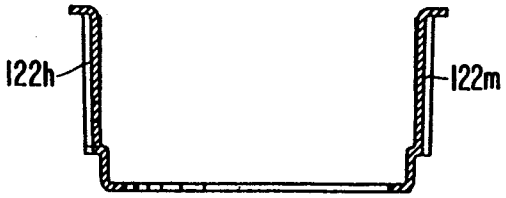
FIG. 22 is a cross-sectional view taken on line 22—22 of FIG. 18.
Figure 21:
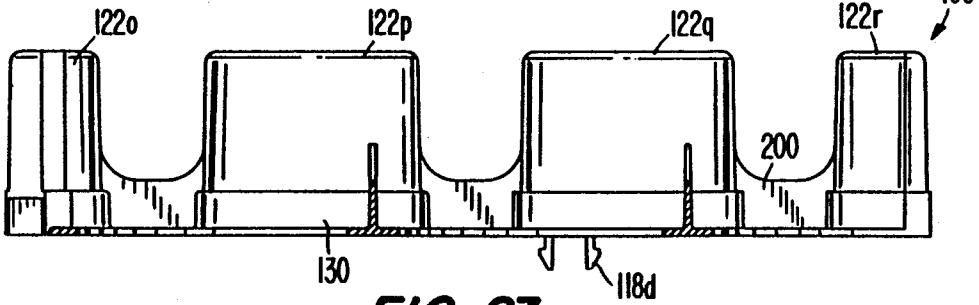
FIG. 21 is a cross-sectional view taken on line 21—21 of FIG. 18.

Each of the columns 122, 124, 126 tapers upward slightly a couple of degrees and each is stepped outward at its base, as shown in FIGS. 20 and 21 for example at 130. For a total divider height of 50.00 mm, only the bottom 10.00 mm base 130 is stepped outward. This allows each of the dividers 106, 108, 110 when stacked one on top of another similar divider to nest about eight millimeters or so into the one below it, which thereby provides a more stable stack of dividers. Each of the columns 122, 124, 126 has between one and four ribs as at 212 on its inside surface extending from top of the step 130 to the top of the column. These ribs 212 provide structural strength to the column 122, 124, 126, and also prevent the dividers, when stacked one on top of another and when weighted down, from being forced down on top of one another and thereby cracking the columns.

Figure 23:
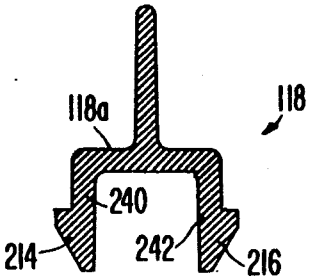
FIG. 23 is a cross-sectional view taken on line 23—23 of FIG. 18.
Figures 29, 30, 31, 32, 33, 34:
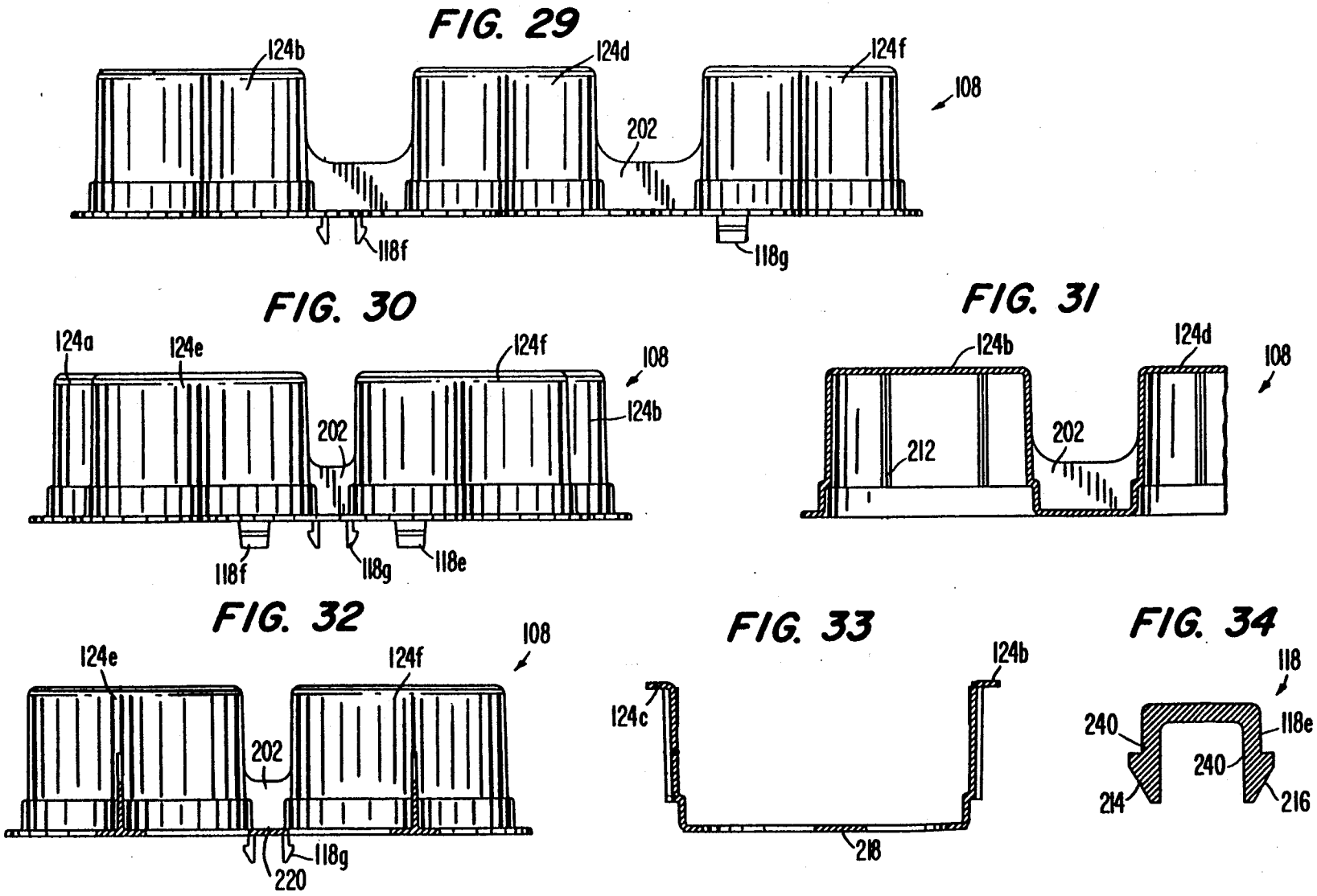
FIG. 29 is a front elevational view thereof.
FIG. 30 is a right end elevational view thereof.
FIG. 31 is a cross-sectional view taken on line 31—31 of FIG. 27.
FIG. 32 is a cross-sectional view taken on line 32—32 of FIG. 27.
FIG. 33 is a cross-sectional view taken on line 33—33 of FIG. 27.
FIG. 34 is a cross-sectional view taken on line 34—34 of FIG. 27.
Figure 43:
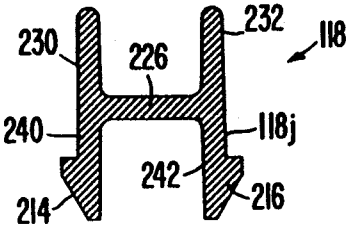
FIG. 43 is an enlarged cross-sectional view taken on line 43—43 of FIG. 37.

The male snapping members 118 of the dividers are configured with a downwardly-opening horseshoe shape as shown in FIGS. 23, 34 and 43, with hooks 214, 216 at opposite outside ends thereof. For each of the dividers 106, 108, 110 at least three male members 118 are provided to lock the divider securely to and prevent twisting thereof in the case 100. Each of these male locking members 118 is positioned at some web, tab or connecting member between or extending out from the divider columns. They are not actually under the columns 122, 124, 126 themselves for production reasons. In the injection molding process of each of the dividers 106, 108, 110 a steel member (not shown) extends up to form inside of each of the columns and if the male lock 118 were positioned underneath the column it would block the positioning of this steel member. Thus, for the first divider 106 each of the locking members 118 extends down from a web 200. In the second divider 108, rib bridges 218, 220 are formed across the two interior pockets to support the male snaps 118*e, f, g*. The pockets remain open on both sides of these bridges 218, 220, however, to allow the bottoms of the bottles B2 in these pockets to be washed through the bottom of the case 100.

Figure 39:
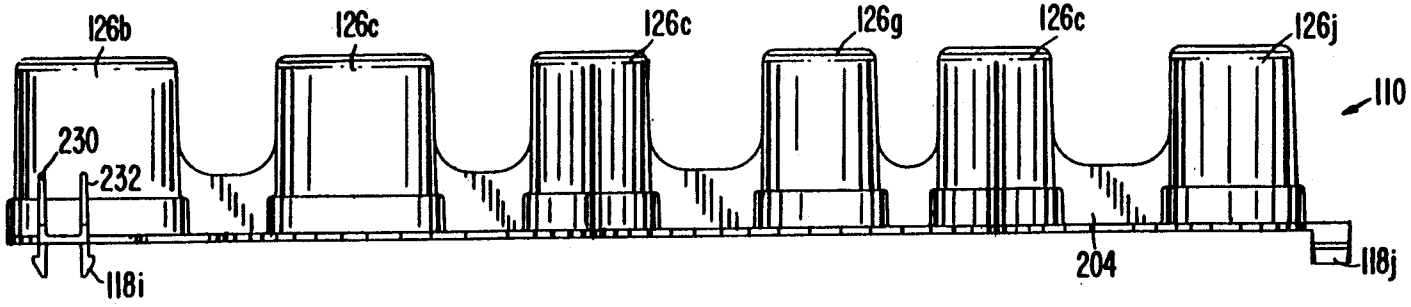
FIG. 39 is a front elevational view of the divider of FIG. 37.
Figure 41:
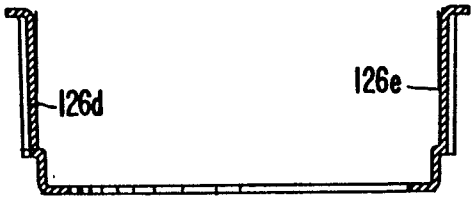
FIG. 41 is a cross-sectional view taken on line 41—41 of FIG. 37.
Figure 40:
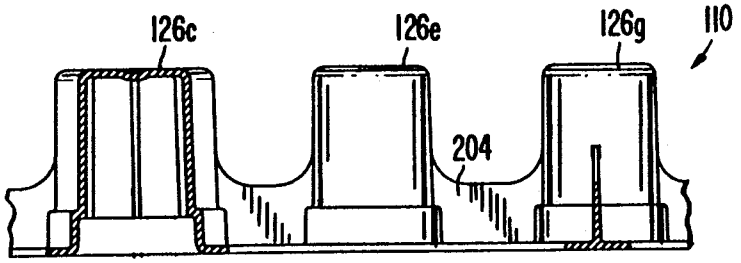
FIG. 40 is a cross-sectional view taken on line 40—40 of FIG. 37.

As mentioned earlier the third divider 110 is configured for 2.0 liter bottles, which are taller than 1.0 and 1.5 liter bottles. The case 100 itself has a height just sufficient so that 2.0 liter bottles can sit directly on the top of the floor construction 106. If they sat on rib bridges 218, 220 on the case floor they would be too tall. Thus, bridges 218, 220 across the pocket floors, as used for the second dividers 108, are not used for the third divider 110, but rather tabs 222, 224, 226 extending out from the divider at locations spaced from or outside of the pockets are used. Outwardly disposed, upright ribs 230, 232 on the outside of the columns, as shown in FIGS. 39 (left side) and 43 structurally support these tabs with the adjacent columns, so the tabs do not tend to snap off. The male locks 118*h, i, j*, then extend down from these tabs 222, 224, 226. Further, the female locking members 114 must themselves be positioned within the octagonal configurations in the floor construction 104 so that they do not interfere with column stacking and cross stacking of the case 100.

Figure 44:
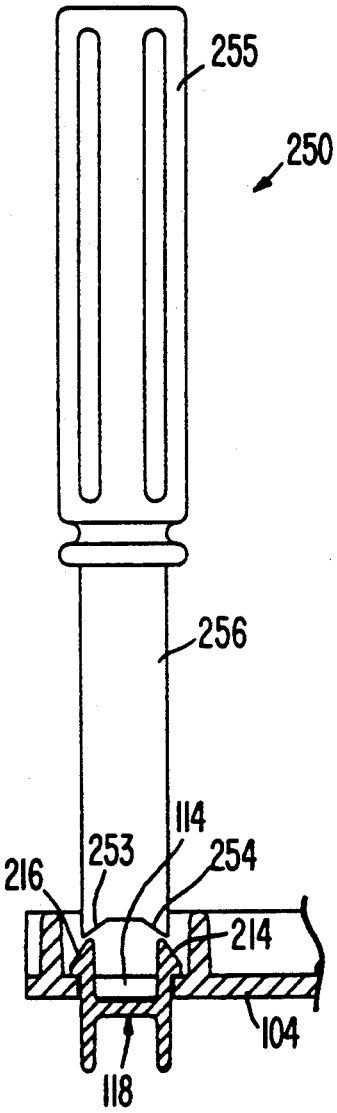
FIG. 44 is a side elevational view of a first tool of the present invention shown releasing one of the male snap securing members of any of the first, second or third dividers of FIGS. 16, 27 or 35 from the corresponding female member in the floor of the case of FIG. 1, shown inverted.
Figure 45:
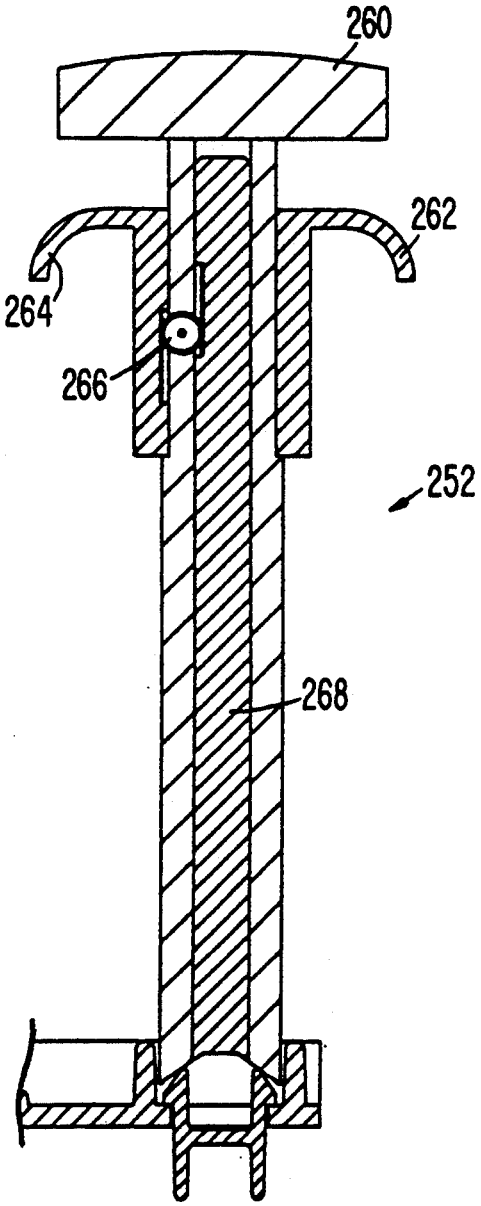
FIG. 45 is a view similar to FIG. 44 illustrating in operation and in cross section a second tool of the present invention.

The outer sides of the hooks 214, 216 of the male members 118 slant inwardly and provide surfaces against which to press the legs 240, 242 of the male member together as it is inserted into the rectangular female locking member 114, and then once the top corners of the male members have passed through the rectangular members the legs snap back out securing the divider in place. FIGS. 44 and 45 show the male members 118 snap fit secured (locked) into the female member 114 and the case 100 upside down. The space between adjacent downwardly projecting rib structure of the floor construction 104 and the male members 118 themselves and given the fact that the male members do not protrude down as much as the bottom rib members of the floor construction, it is extremely difficult if not impossible to insert one's fingers in and push the legs 240, 242 together to unsnap the male members. In fact, as shown in FIG. 13 the access space 246 between the ribs is only about 18.00 mm. Thus, unauthorized persons are prevented from freely removing the dividers 106, 108, 110 for mischief and other unauthorized reasons. To remove the dividers when it is desired to insert a different divider to transport another size of bottle simply requires using a tool of the present invention.

Two embodiments of this tool are shown in FIGS. 44 and 45, generally at 250, 252. Referring thereto it is seen that each has a pair of spaced prongs 254, 256 with outwardly inclined surfaces which when the tool 250, 252 is inserted and pressed down against the male member 118 the prongs 254, 256 slide along the outer surfaces of the hooks 214, 216 and with a camming action press the ends of the leg 240, 242 together so that the male lock can then be removed from the female lock 114. The tool 250 of FIG. 44 is a manual tool where only a positioning and pressure are used. In other words, the tool 250 is placed on the lock 118, and pushed down on handle 255 and thus shaft 256, thereby compressing the legs or teeth 240, 242 of the lock, pushing the male member 118 in through the female locking member 114 of the floor construction 104 and thereby disengaging the lock. In contrast, the tool 252 of FIG. 45 is pushed down to compress the teeth, or legs and with the palm of the user's hand on the top knob 260 his fingers pull up on the finger holds 262, 264. This pulling motion, acting through the gear 266, pushes the inner rod 268 of the tool down. The downward movement of the inner rod, in turn, pushes the teeth 240, 242 through the bottom of the case 100, thereby disengaging the lock. This unlocking action of tools 250 or 252 is then repeated with either of the tools at each (three or four) lock location(s) at the bottom of the case 100.

Figure 46:
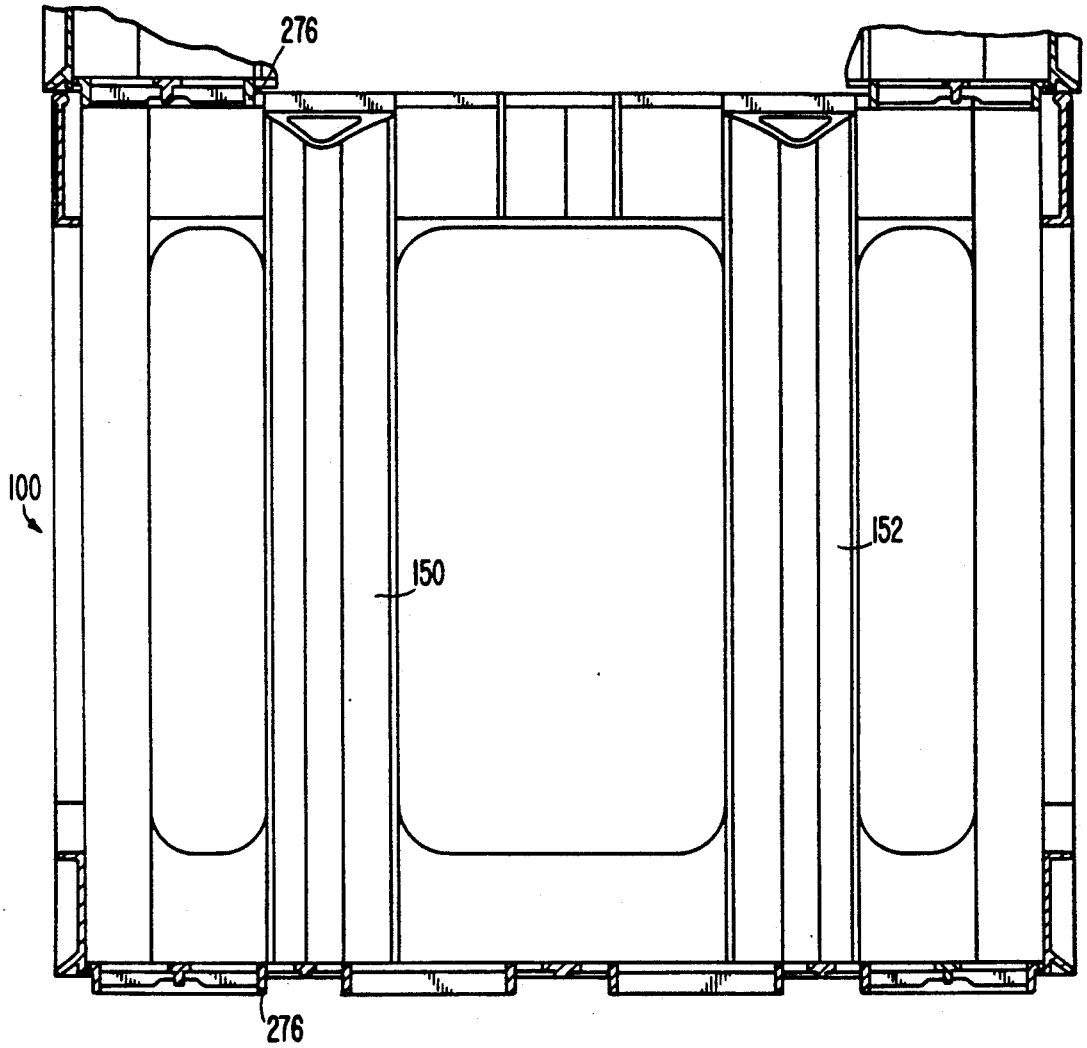
FIG. 46 is a cross-sectional elevational view of the case of FIG. 1, illustrating the locking relation of the case in a column stacking or cross-stacking pattern with a similar or a standard case stacked on top of it or below it.

When this case is stacked, either full or empty, with an identical that is, 416×312 mm cases, or with standard 309×412 mm cases, it is desirable that the cases lock together and thereby be prevented from freely sliding one along the other. Therefore spaced members 276 protruding down from the bottom of the floor and spaced from the perimeter of the floor are provided. These protruding members 276 would fit down within the walls of the case beneath it, as depicted in FIG. 46. They are configured and positioned to provide for various stacking column and cross stacking patterns. Further according to this invention they must be configured so that these cases 100 having dimensions of 416 mm by 312 mm can stack and column stack with cases having smaller dimensions such as 309 mm by 412 mm. To accommodate this, the protruding members 276 are uniquely configured as octagons according to the present invention, that is, squares with each of the four corners thereof cut off, and thereby providing for additional play to accommodate different cases and different cross stacking patterns. Referring to FIG. 1, the three by four array of octagons together with the grid of longitudinal and lateral ribs 278, 280, 282, 244 both through and between the octagons forms an aesthetically pleasing gridwork design. It will be appreciated that with different sizes and configurations of cases and dividers that different numbers and placements of the female members would likely be used than those illustrated in FIG. 1, for example.

From the foregoing detailed description, it will be evident that there are a number of changes, adaptations and modifications of the present invention which come within the province of those persons having ordinary skill in the art to which the aforementioned invention pertains. For example, the present full-depth case and divider assembly can be adapted to handle bottles or other types of generally cylindrical articles of different sizes, widths, numbers or materials other than those set forth herein. If the assembly were to handle glass instead of PET bottles, partitions between the bottles extending up five inches or so to prevent the bottles from scratching each other could be used. However, it is intended that all such variations not departing from the spirit of the invention be considered as within the scope thereof as limited solely by the appended claims.

What is claimed is:

1. A full-depth bottle case assembly for different sets of bottles of different sizes, said assembly comprising:

a full-depth bottle case including a full-depth wall structure, a floor construction secured to said wall structure, and locking floor members on said floor construction;

a first divider having a first set of locking divider members positioned such that, when said first divider is in a snapped-in position in said bottle case, said locking divider members of said first set are releasably engaged relative to at least some of said locking floor members, said first divider being configured such that when in the snapped-in position said first divider and said bottle case together form a plurality of first pockets for holding upright therein a plurality of first bottles; and a second divider having a second set of locking dividers members positioned such that, when said second divider is in a snapped-in position in said bottle case, said locking divider members of said second set are releasably engaged relative to at least some of said locking floor members, said second divider being configured such that when in the snapped-in position said second divider and said bottle case together form a plurality of second pockets, of a different width size than said first pockets, for holding upright therein a plurality of second bottles of a different bottle width than that of the first bottles;

said floor construction comprising a gridwork floor construction;

said locking floor members including a first plurality of open rectangular members integrally formed with said floor construction and a second plurality of open rectangular members integrally formed with said floor construction and at least in part different from said first plurality;

said first set of locking divider members comprising a first set of downwardly-depending male locking members which, when said first divider is in the snapped-in position, are engaged in said first plurality of open rectangular members; and said second set of locking members comprising a second set of downwardly-depending male locking members which, when said second divider is in the snapped-in position, are engaged in said second plurality of open rectangular members.

2. The assembly of claim 1 wherein all of said first plurality of rectangular members are different from all of said second plurality of rectangular members.

3. The assembly of claim 2 wherein said first plurality of open rectangular members form a pattern which is disposed asymmetrically with respect to the longitudinal axis of said floor construction.

4. The assembly of claim 2 wherein said first plurality of open rectangular members form a pattern which is disposed asymmetrically with respect to the lateral axis of said floor construction.

5. The assembly of claim 2 wherein at least one of said rectangular members has its longitudinal and lateral axes askew with respect to the longitudinal and lateral axes of said floor construction.

6. The assembly of claim 2 wherein said gridwork floor construction includes an array of rib members each defining a similarly-shaped closed configuration and each of said open rectangular members of said first set is positioned inside of said closed configurations.

7. The assembly of claim 6 wherein each of said closed configurations defines an octagon.

8. The assembly of claim 7 wherein said wall structure comprises a rectangle of four walls and said array comprises a three-by-four array whose outer edges are directly adjacent each of said four walls.

9. The assembly of claim 2 wherein at least one of said first and second dividers is dimensioned and configured such that when in the snapped-in position it is spaced a distance inward at all locations from said wall structure.

10. A full-depth bottle case assembly for different sets of bottles of different sizes, said assembly comprising:

a full-depth bottle case including a full-depth wall structure, a floor construction secured to said wall structure, and locking floor members on said floor construction;

a first divider having a first set of locking divider members positioned such that, when said first divider is in a snapped-in position in said bottle case, said locking divider members of said first set are releasably engaged relative to at least some of said locking floor members, said first divider being configured such that when in the snapped-in position said first divider and said bottle case together form a plurality of first pockets for holding upright therein a plurality of first bottles; and a second divider having a second set of locking dividers members positioned such that, when said second divider is in a snapped-in position in said bottle case, said locking divider members of said second set are releasably engaged relative to at least some of said locking floor members, said second divider being configured such that when in the snapped-in position said second divider and said bottle case together form a plurality of second pockets, of a different width size than said first pockets, for holding upright therein a plurality of second bottles of a different bottle width than that of the first bottles;

said locking floor members comprising female locking members;

said first divider including a plurality of laterally and outwardly extending tabs; and said locking divider members of said first set including a plurality of male locking members, each extending downwardly from a separate said tab.

11. The assembly of claim 10 wherein each of said male locking members includes a pair of spaced legs, each having a distal end hook.

12. The assembly of claim 11 wherein said distal end hooks are on opposite side ends of said legs, and said legs and hooks all are positioned on the same outwardly facing vertical plane.

13. The assembly of claim 11 wherein each said locking member and its corresponding said tab forms an "H" in vertical lateral cross-section.

14. The assembly of claim 11 wherein said tabs comprise, with said first divider in the snapped-in position, a first tab oriented longitudinally with respect to said floor construction and a second tab oriented laterally with respect to said floor construction.

15. The assembly of claim 11 wherein one of said tabs is positioned in any of said first pockets.

16. The assembly of claim 11 wherein at least one of said first and second dividers is dimensioned and configured such that when in the snapped-in position it is spaced a distance inward at all locations from said wall structure.

17. A full-depth bottle case assembly for different sets of bottles of different sizes, said assembly comprising:

a full-depth bottle case including a full-depth wall structure, a floor construction secured to said wall structure, and locking floor members on said floor construction;

a first divider having a first set of locking divider members positioned such that, when said first divider is in a snapped-in position in said bottle case, said locking divider members of said first set are releasably engaged relative to at least some of said locking floor members, said first divider being configured such that when in the snapped-in position said first divider and said bottle case together form a plurality of first pockets for holding upright therein a plurality of first bottles; and a second divider having a second set of locking dividers members positioned such that, when said second divider is in a snapped-in position in said bottle case, said locking divider members of said second set are releasably engaged relative to at least some of said locking floor members, said second divider being configured such that when in the snapped-in position said second divider and said bottle case together form a plurality of second pockets, of a different width size than said first pockets, for holding upright therein a plurality of second bottles of a different bottle width than that of the first bottles;

one of said first pockets comprises an interior pocket spaced inward from said wall structure;

said first divider includes a rib extending across said interior pocket at the base thereof; and one of said locking divider members of said first set extends down from said rib.

18. The assembly of claim 17 wherein said interior pocket defines a first interior pocket, said rib defines a first rib, said one said locking member defines a first locking member, another one of said first pockets comprises a second interior pocket, said first divider includes a second rib extending across said second interior pocket at the base thereof and another of said locking divider members of said first set includes a second locking member extending down from said second rib.

19. The assembly of claim 18 wherein, with said first divider in the snapped-in position, said first rib is positioned longitudinally with respect to said floor construction and said second rib is positioned laterally with respect to said floor construction.

20. The assembly of claim 18 wherein at least one of said first and second dividers is dimensioned and configured such that when in the snapped-in position it is spaced a distance inward at all locations from said wall structure.

* * * * *